US012740613B1

(12) United States Patent
Yang et al.

(10) Patent No.: US 12,740,613 B1
(45) Date of Patent: Sep. 22, 2026

(54) PROTECTIVE COVER FOR SPIKED ATHLETIC SHOES, FOR USE BEFORE/AFTER SPORTING EVENTS AND WHEN STORED IN AN ATHLETIC BAG

(71) Applicant: TEKS, Inc., Ithaca, NY (US)

(72) Inventors: Puxuan Yang, Plymouth, MA (US); David Bruk-Rodriguez, Winter Haven, FL (US); Rachel Bonnet, Haddonfield, NJ (US)

(73) Assignee: TEKS, Inc., Ithaca, NY (US)

( * ) Notice: Subject to any disclaimer, the term of this patent is extended or adjusted under 35 U.S.C. 154(b) by 50 days.

(21) Appl. No.: 18/978,010

(22) Filed: Dec. 12, 2024

Related U.S. Application Data

(60) Provisional application No. 63/608,858, filed on Dec. 12, 2023.

(51) Int. Cl.
*A43B 5/18* (2006.01)

(52) U.S. Cl.
CPC ..... *A43B 5/185* (2013.01)

(58) Field of Classification Search
CPC .... A43B 3/16; A43B 3/18; A43B 5/18; A43B 5/185
USPC ..... 36/135, 7.3
See application file for complete search history.

(56) References Cited

U.S. PATENT DOCUMENTS 3,026,635 A * 3/1962 Slade ..... A43B 3/16 264/DIG. 60
3,313,047 A * 4/1967 Svien ..... A43B 5/18 36/135
3,858,336 A * 1/1975 Brown ..... A43B 5/185 36/135
4,727,662 A * 3/1988 Ilon ..... A43B 5/0419 36/62
6,988,328 B2 * 1/2006 Rosen ..... A43B 3/18 36/73
D595,485 S * 7/2009 Tvoua ..... D2/917
11,369,161 B2 * 6/2022 Crary ..... A43B 13/223
2009/0235556 A1 * 9/2009 Reid ..... A43B 3/163 36/7.1 R
2009/0307929 A1 * 12/2009 Tvoua ..... A43B 3/26 36/97
2010/0251562 A1 * 10/2010 Barrick ..... A43B 3/16 36/7.6
2016/0213092 A1 * 7/2016 Bell ..... A43C 15/066
(Continued)

*Primary Examiner* — Ted Kavanaugh

(74) *Attorney, Agent, or Firm* — James Bongiorno; Thomas A. O'Rourke; O'Rourke IP Law, PLLC

(57) ABSTRACT

A cover for a spiked athletic shoe includes toe and heel portions, and a particular mid-section with one or more selective shapes forming an accordion-like structure providing adjustability for a distance between the toe and heel portions. The mid-section is also configured to provide vertical support to a mid-portion of the shoe at each of the first and second ends of the cover's mid-section, being the same as a level of support provided thereat by the toe portion and the heel portion. To mount the cover, a force is applied causing elastic expansion of the selective shape permitting contact between the bottom of the cover and the sole of the shoe, and releasing the force results in contraction of the mid-section, for engagement and securement of the toe portion and heel portion to the front and rear of the shoe, to thereby retain the cover on the shoe.

8 Claims, 24 Drawing Sheets

(56) References Cited

U.S. PATENT DOCUMENTS

| | | | | |
|---|---|---|---|---|
| 2016/0366982 | A1* | 12/2016 | Chaney | A43C 15/061 |
| 2018/0116330 | A1* | 5/2018 | Christian | A43B 13/187 |

* cited by examiner

PROTECTIVE COVER FOR SPIKED ATHLETIC SHOES, FOR USE BEFORE/AFTER SPORTING EVENTS AND WHEN STORED IN AN ATHLETIC BAG

CROSS-REFERENCES

This application claims priority on U.S. Provisional Patent Application Ser. No. 63/608,858, filed on Dec. 12, 2023, the disclosures of which are incorporated herein by reference.

FIELD OF THE INVENTION

The present invention relates generally to covers for shoes, and more particularly relates to an improved cover or overshoe for spiked athletic shoes that is usable while wearing those shoes and walking around, and while warming up prior to an athletic event.

BACKGROUND OF THE INVENTION

Specialized shoes with protrusions on a bottom surface of the sole are worn by men and women to provide an anti-skid traction capability and for added stability during many different athletic events and sporting activities. For example, golfer wear golf shoes in which the protrusions are slender spikes; baseball players wear shoes with cleats that are typically metal; football players and soccer players wear shoes that typically have knob-like protrusions that protrude away from the bottom of the sole; and cross-country runners, as well as track and field athletes, usually compete wearing shoes that have replaceable metal spikes (see FIG. 5 and FIG. 6).

For a top-level athlete to maintain a competitive advantage, and moreover, to just maintain adequate effectiveness of such athletic shoes, the spikes need to be replaced. Track and Field athletes frequently change out the spike in their competition shoes because the tips become dull/rounded and are less effective due to wear from contact with hard surfaces while walking around prior to, in-between, and after events. Dull spikes tend to dull athletic performance. In fact, because of the wear associated with the spikes contacting hard surfaces such as asphalt and/or concrete walkways, even avid golfers change the spikes in their golf shoes at least twice a season.

To lessen the wear on the tips of each spike, many competitors, particularly track and field athletes, will typically carry their spiked shoes in a gym bag to each event, and only change into those competition shoes from ordinary training shoes right before his or her event. However, having to change shoes multiple instances takes time and distracts from a competitors focus on the upcoming event(s); moreover, the spikes tend to cause damage to other contents transported in the gym bag, i.e., causing snags to expensive apparel, and scratches to costly laptop computers (see e.g., FIG. 21). Also, that routine is inconvenient, as the athlete must either carry the athletic bag onto the field and tote it around, or otherwise carry the race spikes in his/her hands for a sustained period of time. The inconvenience is compounded for athletes who compete (e.g., run) in multiple events, and is even more inconvenient for athletes who compete in a heptathlon (7 events for women) or a decathlon (10 events for men).

The problem experienced by track and field participants is further exacerbated because the spikes are only on the front (ball) portion of the shoe, causing the spiked shoe when being worn by the athlete to be angled upwardly while walking on a hard surface before/after an event, which tends to be uncomfortable in addition to being detrimental to the sharpness of the metallic spikes.

These problems are recognized by competitors at all levels of these various different sports, including many Olympic athletes.

There are many prior art shoe covers that have attempted to address this problem of protecting the tips of spikes on spiked athletic shoes. However, most of these have only addressed the issue of protecting the spikes to the exclusion of other aspects of the issues faced by the athlete, as many of these inventions are very cumbersome to apply onto, and remove from, the spiked competition shoes, without damaging a portion of the shoe cover itself; see e.g., WO2022117388 for a "Protective Shell for a Nailed Boot," which describes in paragraph fifty-nine that a "cushion 130 is positioned in force in the front part . . . of the sole" and that a "transverse stop 103 makes it possible" to "change the cushion 130 very easily if it deteriorates."

Moreover, none of prior art inventions adequately address another problem, which is that of being able to appropriately fit the cover onto the particular sized shoe of the athlete's competition spikes without being custom designed in each case (see e.g., U.S. Pat. No. 2,958,963 to Lougheed; U.S. Pat. No. 3,020,654 to McCann; U.S. Pat. No. 4,258,483 to Hogue; and U.S. Pat. No. 4,484,398 to Goodwin), and prior art solutions that do address that aspect have not adequately addressed another problem: simultaneously being able to adequately secure the device to the competition spikes. See e.g., U.S. Pat. No. 7,779,560 to Kay, U.S. Pat. No. 8,215,038 to Satler, and U.S. Patent App. Pub. No. 2019/0208857 by Constantine.

Thus all the prior art solutions to date fail to provide a robust solution to wearing of the overshoe as if it is an integral part of the various different spiked athletic shoes that need to be protected, while being easy to apply and remove, while snugly fitting on the spiked shoe, and while providing a comfortable, well-supported platform for all portions of the spiked athletic shoes—the front ball portion, the mid-section, and the heel portion, making the athlete feel as if they are only wearing his/her training shoe, rather than competition spikes.

The herein disclosed shoe cover provides improvements upon the prior art and addresses all of these long felt but unmet needs.

It is noted that although the shoe cover structure disclosed hereinafter is generally described with respect to track and field spikes (or "spiked running shoes"), it is to be understood that the herein disclosed device may be adaptable for use with all other similar shoes by, e.g., adjusting the corresponding recess to accommodate the particular size/shape of the knobs, cleats, spikes, etc. of the other types/models of athletic shoes with such protrusions.

It is also noted that the citing of any reference within this disclosure, i.e., any patents, published patent applications, and non-patent literature, is not an admission regarding a determination as to its availability as prior art with respect to the herein disclosed and claimed method/apparatus.

Objects of the Invention

It is an object of the invention to provide a protective cover for athletic shoes that have protrusions that protrude down from the bottom surface of the sole.

It is another object of the invention to provide a wearable cover for golf shoes, track & field spikes, baseball cleats, and/or the like, that fits as if it is an integral part of the various different spiked athletic shoes being protected.

It is a further object of the invention to provide a wearable cover for golf shoes, track & field spikes, baseball cleats and/or the like, which is easy to apply and remove.

It is another object of the invention to provide a wearable cover for golf shoes, track & field spikes, baseball cleats and/or the like, which is easily applied and removed, while nonetheless fitting snugly and securely onto the spiked shoe.

It is a further object of the invention to provide a wearable cover for golf shoes, track & field spikes, baseball cleats and/or the like, which provides a comfortable, well-supported platform for all portions of the spiked athletic shoes—the front ball portion, the mid-section, and the heel portion, making the athlete feel as if he/she is wearing a pair of training shoes, rather than competition spikes.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

A cover, for use with an athletic shoe having anti-skid protrusions (e.g., pointed spikes, rubber cleats, etc.) on one or more portions of a bottom surface of a sole of the athletic shoe, may include: a toe portion; a heel portion; and a particularly formed mid-section. One end of the midsection is joined to the toe portion, and the second end of the mid-section is joined to the heel portion. Thus, the mid-section may be formed separately and may subsequently be secured to the toe and heel portion, or alternatively the toe portion, the heel portion, and the mid-section may instead be integrally formed as a single unitary part.

The mid-section consists of one or more selective shapes that are formed as an accordion-like structure, being configured to provide adjustability with respect to a distance between the toe portion and the heel portion. The accordion-like structure of the mid-section is configured to provide vertical support to a mid-portion of the athletic shoe when being worn, such that the vertical support provided by the accordion-like structure at each of a first end and a second end of the mid-section is respectively configured to provide a level of support being substantially the same as a level of support provided thereat by the toe portion and the heel portion.

The selective shape forming the accordion-like structure is configured to respond to application of a force by permitting elastic expansion for application onto the athletic shoe, and also results in contraction upon release of the force, for engagement and securement of the toe portion and heel portion with respect to the athletic shoe, to thereby retain the cover on the athletic shoe. The selective shape forming the accordion-like structure is configured to expand using a combination of linear elastic deformation according to Poisson's ratio (i.e., strain in the short and long transverse directions resulting from axial strain), and three-dimensional shape changes to the particular selective shape of the mid-section. The selective shape forming the accordion-like structure of the shoe cover may be formed to exhibit a spring constant in an undeformed state in the range of about one-half of a pound per inch to about thirty pounds per inch, which may be achieved through one or more of: use of the particular shape, use of the particular material, and local thinning of the material at select locations (e.g., at the narrowed opposite ends of the elongated shape).

The shoe cover may be formed of a single material from the group consisting of: thermoplastic polyurethane, rubber, and silicone. Alternatively, various different portions of the shoe cover may be formed of one or more different materials, including, but not limited to, one or more of: thermoplastic polyurethane, polyvinyl chloride, natural rubber, silicone rubber, blown rubber, a composite material, etc.

BRIEF DESCRIPTION OF DRAWINGS

FIG. 1 is a perspective view of a wearable cover configured to fit over at least the sole and spikes of golf shoes, track & field spikes, baseball cleats, and/or the like.

FIG. 11AI is the shoe cover as seen in FIG. 11A, but shown after a force is applied to move the rear portion of the cover away from the front portion to expand and deform the shape of the diamond-shaped accordion-like structure at the mid-section of the cover.

DETAILED DESCRIPTION OF THE INVENTION

FIGS. 1-4 show a wearable shoe cover 100 that is usable to protect the spikes of a spiked athletic shoe 99, including, but not limited to, golf shoes, track & field spikes, cross-country spikes, baseball cleats, soccer shoes, football shoes, and the like.

Figure 7:
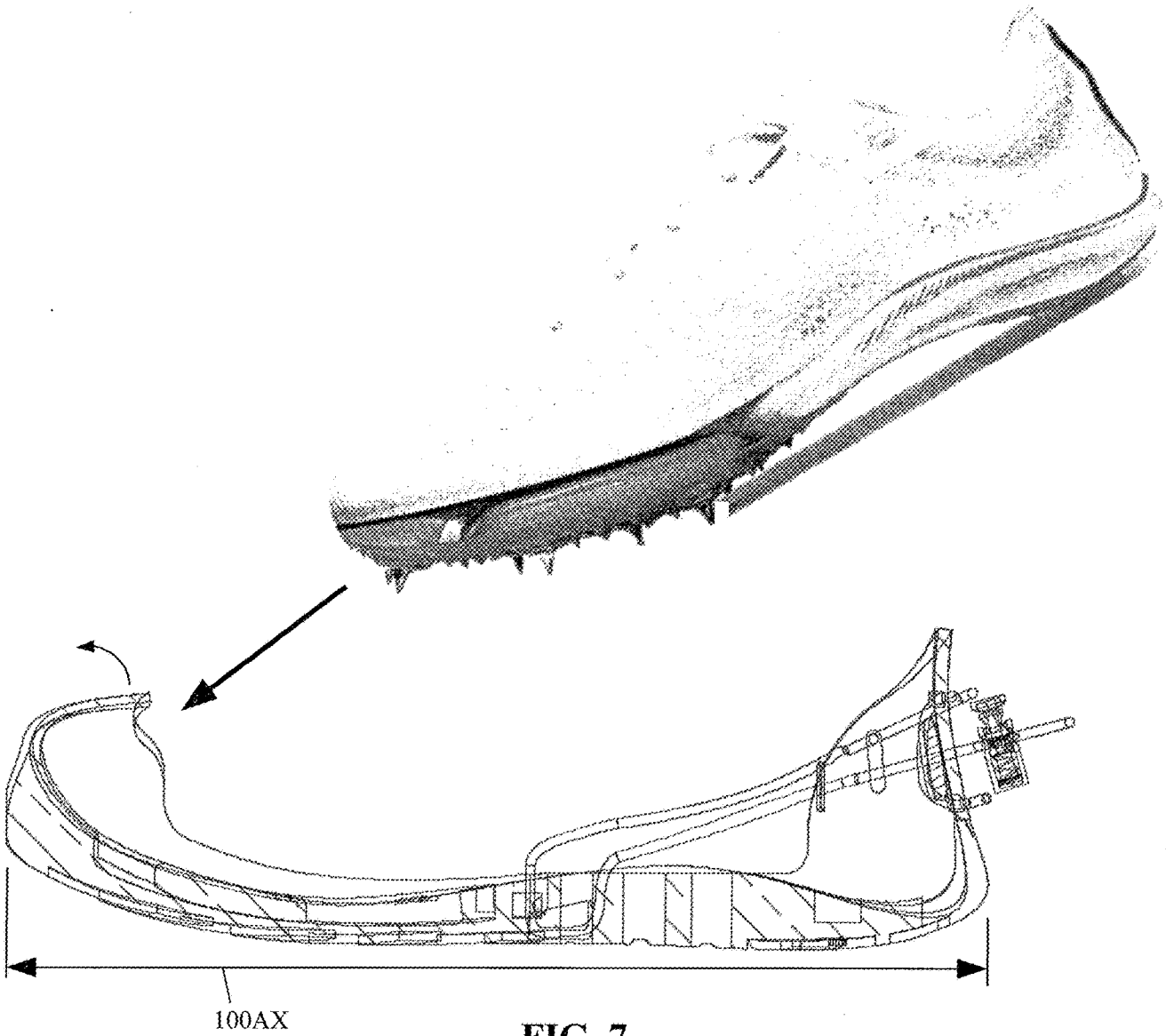
FIG. 7 is a side view illustrating the spiked athletic shoe of FIG. 5 shown just prior to being inserted into the shoe cover of FIG. 1.

The wearable shoe cover 100 includes a front portion 100A, a mid-portion 100B, and a rear portion 100C. The front portion 100A of the wearable shoe cover 100 may be configured as a "toe box" that may engage with the front (toe) region of the wearer's spiked athletic shoe 99, and the front portion 100A may include a sole portion 103 and a toe wall 104. The toe wall 104 may taper down in height/curvature in moving from its frontmost location towards the rear part of the front portion 100A (i.e., being shallower in height between the front of the front portion 100A and the rear of the rear portion 100C. The sole portion 103 may be configured to be penetrated by the spikes, or alternatively, the sole portion 103 may include a recess 103R that may be sufficiently deep and expansive so that the protrusions of the spikes 99S may be suspended therein without its distal-most portion (i.e., its pointed tip 99T) making contact with the adjacent part of the sole portion 103. It is noted that the size and shape (e.g., the depth and peripheral outline) of the recess 103R may be adjusted as needed to accommodate any particular sized/shaped knobs, cleats, spikes, etc. of the various types/models of athletic shoes with such different protrusions/spikes (i.e., the differing shoe protrusion geometries). The front portion 100A may also include a pad 103P that may be configured to be received within and entirely fill the recess 103R, and into which pad the tips of the spikes 99S may be pressed. The pad 103P may be formed of an elastomeric material, or any other suitable material that preferably may not tend to degrade as result of being penetrated repeatedly by the tips of the spikes 99S, and which may also be easily replaced (e.g., the pad may be held in place by a friction fit, and/or through the use of hook and look fastening materials). The pad 103P may provide added stability to the spiked athletic shoe 99 through engagement with the spikes and contact with the corresponding sole portion of the spiked athletic shoe 99. It is noted that the crown (upper) portion 104CR of the toe wall 104 may be formed of a flexible elastic material that that may also taper in thickness towards its distal (rear) end, and it may permit sufficient deflection when the person applies the wearable shoe cover 100 to his/her spiked athletic shoe 99 (see FIG. 7), so that the spikes 99S need not slide forwardly into to the pad so as to gouge the pad, and may instead just be inserted in the axial direction of the spike centerline, with the elastic deforming of the crown (upper) portion 104CR preventing tearing into the pad by the tip of the spike. The front portion 100A may also be configured to utilize a sufficient cross-sectional area/moment of inertia to provide vertical and lateral structural support for the front (toe and ball) region of the wearer's spiked athletic shoe 99, while bearing the full weight of the runner (i.e., the ground reaction forces).

The rear portion 100C of the wearable shoe cover 100 may be configured to engage with the rear (heel) region of the wearer's spiked athletic shoe 99, and may include a sole portion 106 and an Achillies-tendon-adjacent wall 107. The Achillies-tendon-adjacent wall 107 may taper down in height/curvature in moving from the rearmost portion towards the front of the rear portion 100C. The rear portion 100C may also be configured to utilize a sufficient cross-sectional area/moment of inertia to provide vertical and lateral structural support for the rear (heel) region of the wearer's spiked athletic shoe 99 while bearing the full weight of the athlete (i.e., the corresponding ground reaction forces), including the ground impact loading.

Figure 8:
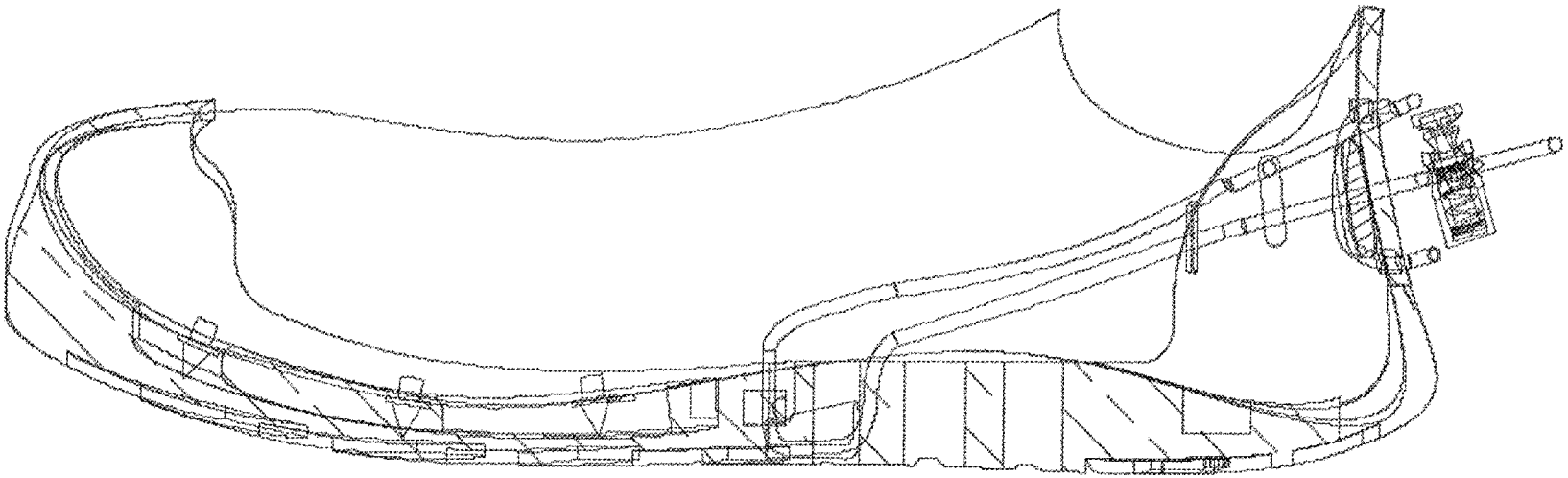
FIG. 8 is the side view of FIG. 7 shown just after the shoe cover of FIG. 1 has been secured onto the spiked athletic shoe of FIG. 5.
Figure 9:
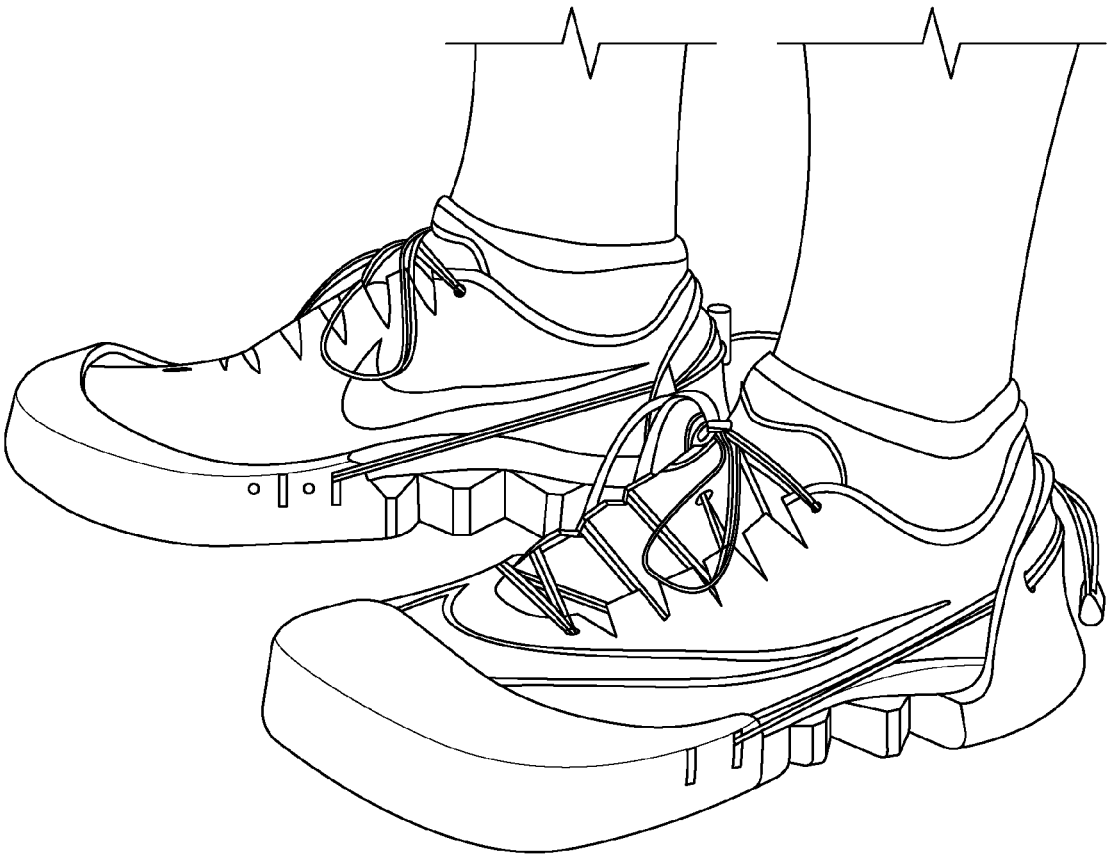
FIG. 9 is a perspective view showing an athlete wearing a shoe cover, as illustrated in FIG. 1, upon each of his/her left and right spiked running shoes.
Figure 11A:
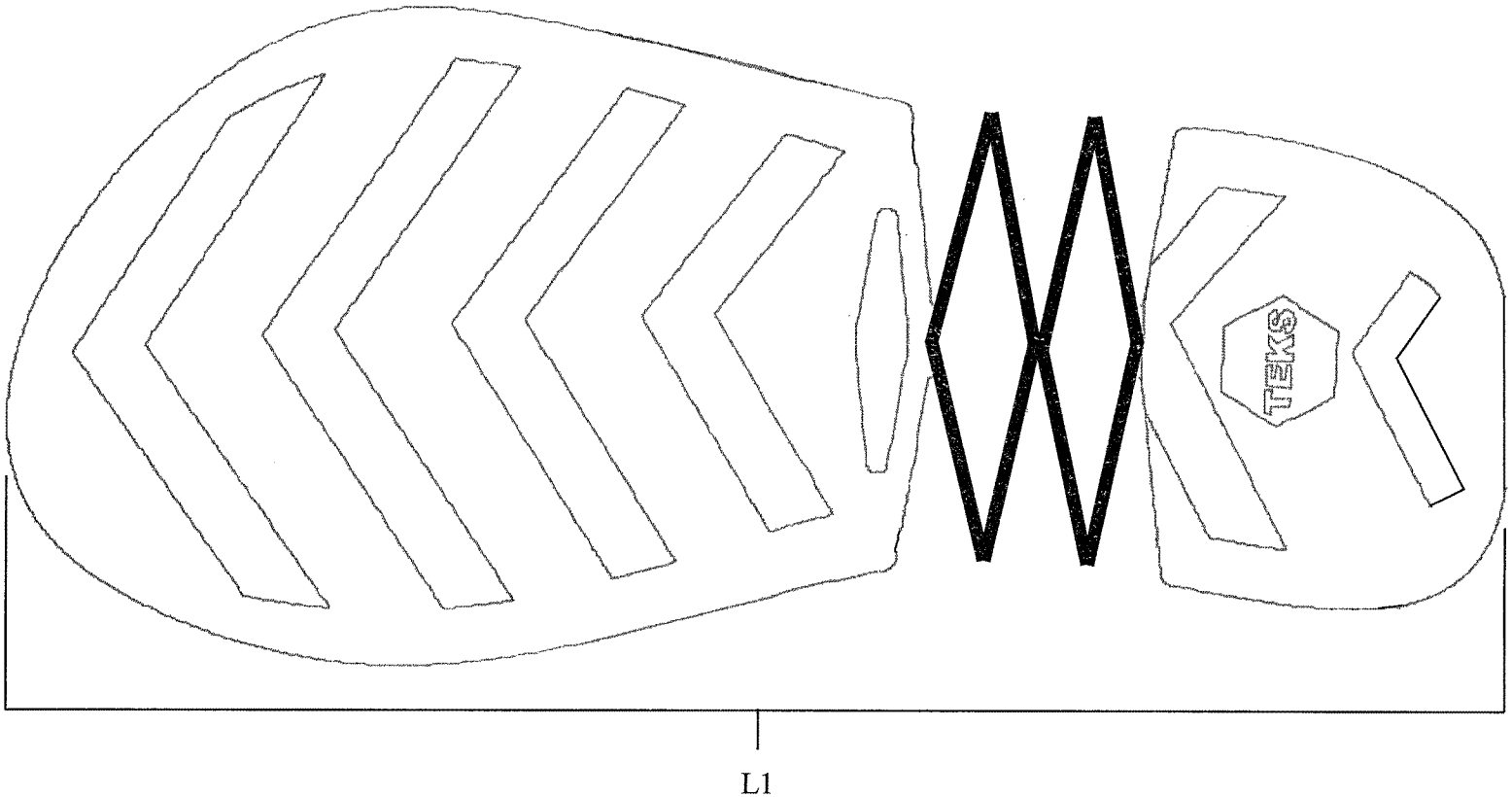
FIG. 11A is the shoe cover as seen in the bottom view of FIG. 4, but is shown with a different structural arrangement for the accordion-like structure at the mid-section of the cover.
Figure 11A:
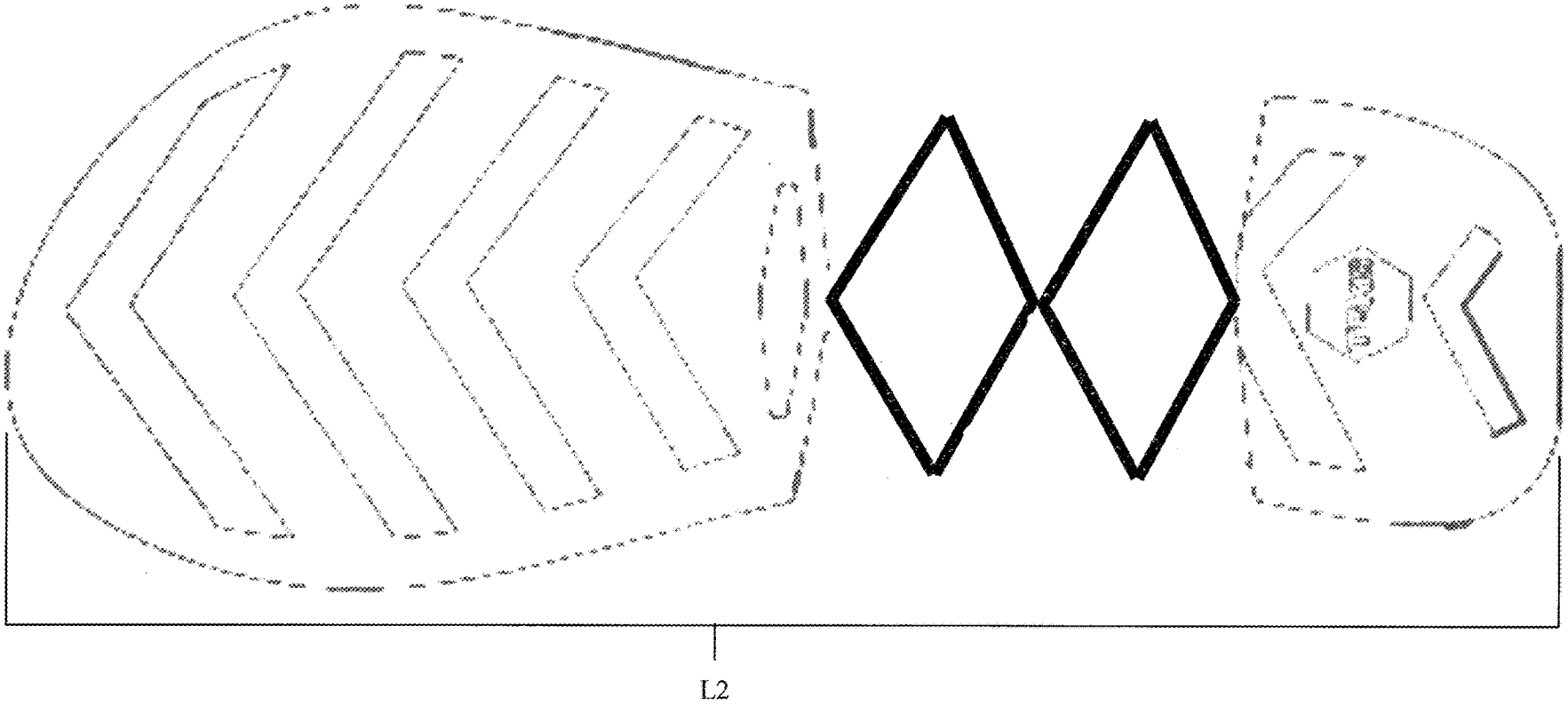

The mid-portion 100B of the wearable shoe cover 100 is uniquely configured by being formed as an accordion-like structure that is particularly configured to serve at least two main functions. The accordion-like structure provides elastic expansibility between the front portion 100A and the rear portion 100C, for adjusting a distance therebetween at least to accommodate applying the wearable shoe cover 100 to the spiked athletic shoe 99 (see FIG. 7 and FIG. 8). The accordion-like structure may furthermore facilitate adjustability such that the wearable shoe cover 100 may be a one-size fits all shoe cover, accommodating and protecting the spikes 99S for a spiked athletic shoe 99 being in a range of sizes from size 6½ to size 13, in simultaneous combination with the provision of structural support to the mid-portion of the spiked athletic shoe when being worn (e.g., compare the distance L1 in FIG. 11A with the distance L2 in FIG. 11AI in which the accordion-like structure has been expanded to accommodate the largest shoe size, e.g., size 13). In one embodiment, the accordion-like structure may be able to flex in the range of 1-5 cm, and in another embodiment, it may be able to flex in the range of 6-7 cm, and in yet a further embodiment, it may be able to flex in the range of 7-10 cm, and in other embodiments a combination of those ranges of other expansible ranges may also be accommodated by the accordion-like structure.

The accordion-like structure may be flexibly expansible in the axial direction 100AX of the wearable shoe cover 100 (FIG. 7) and also in a lateral direction 100LAT (FIG. 3), while exhibiting substantially rigid vertical support to a mid-portion of the spiked athletic shoe 99 when being worn, with this vertical support of the accordion-like structure being substantially the same as a level of vertical support provided by each of the front portion 100A and the rear portion 100C of the wearable shoe cover 100.

Figure 1:
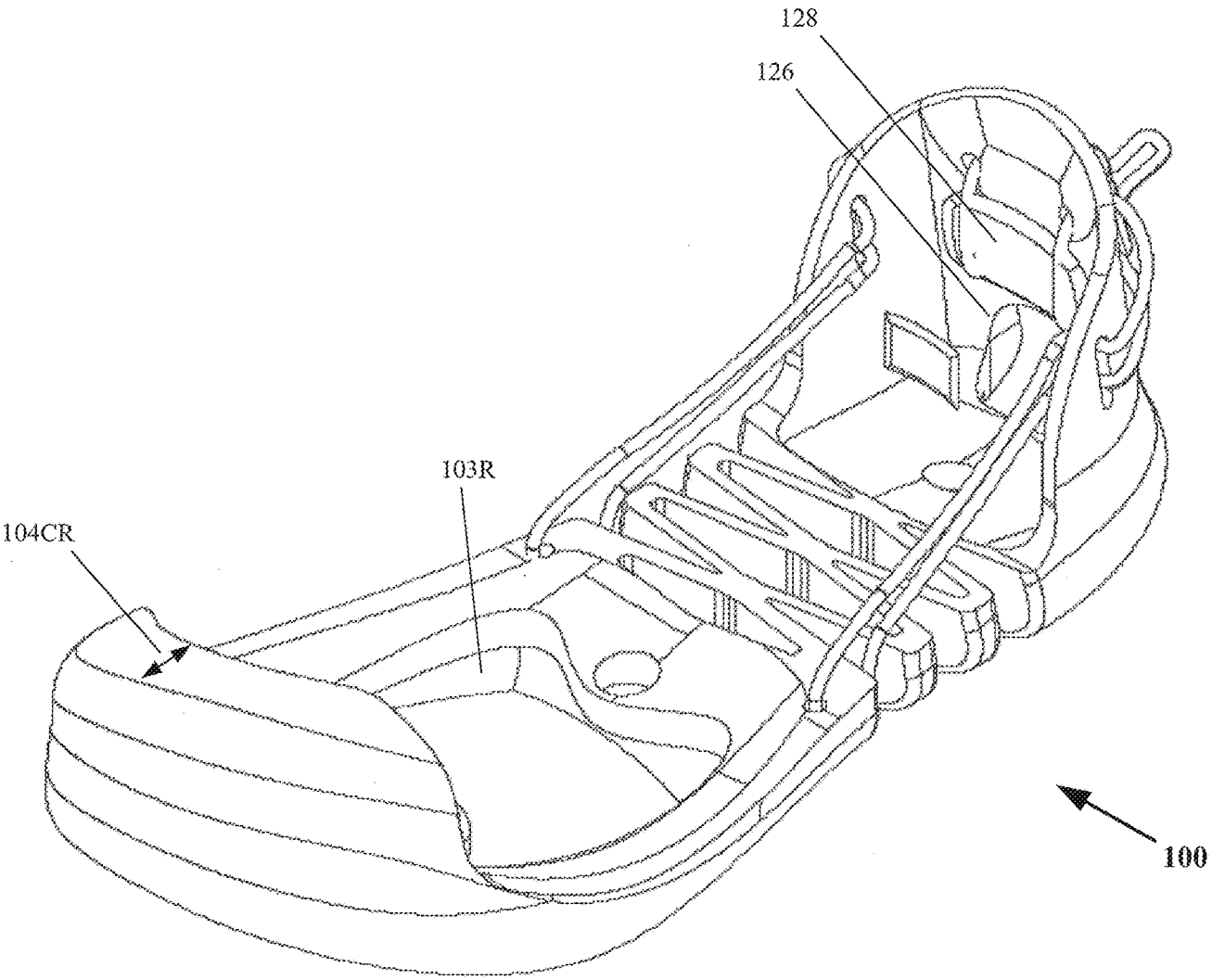
Figure 2:
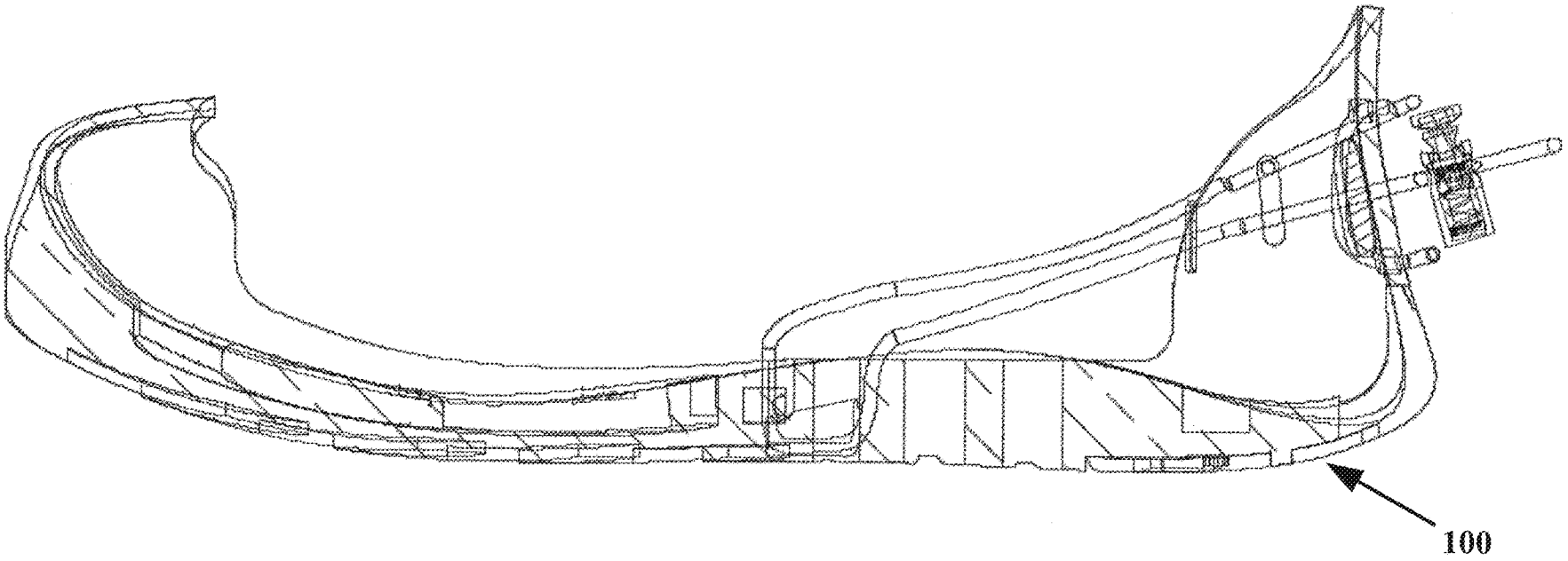
FIG. 2 is a side view of the wearable shoe cover of FIG. 1.
Figure 3:
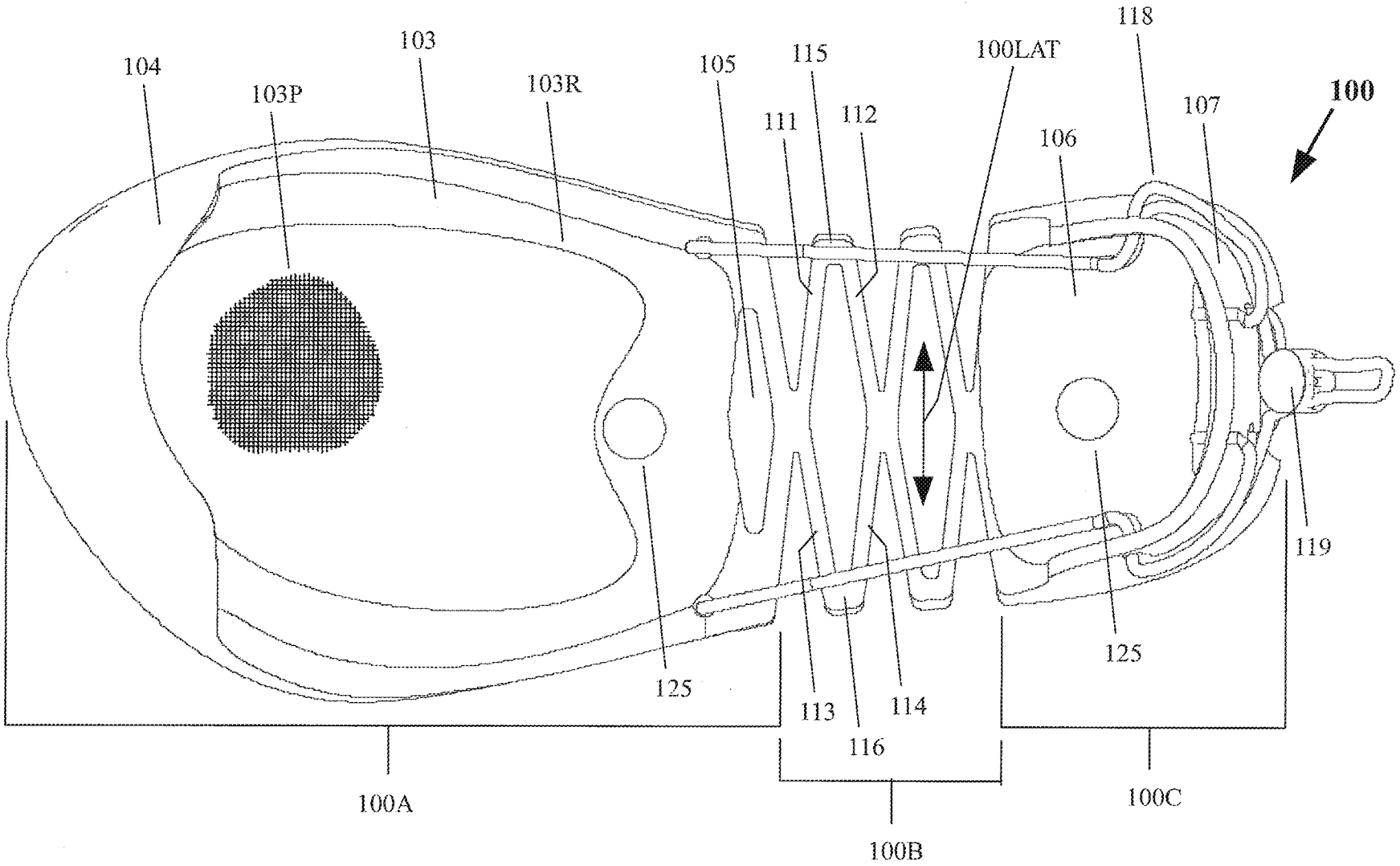
FIG. 3 is a top view of the wearable shoe cover of FIG. 1.
Figure 4:
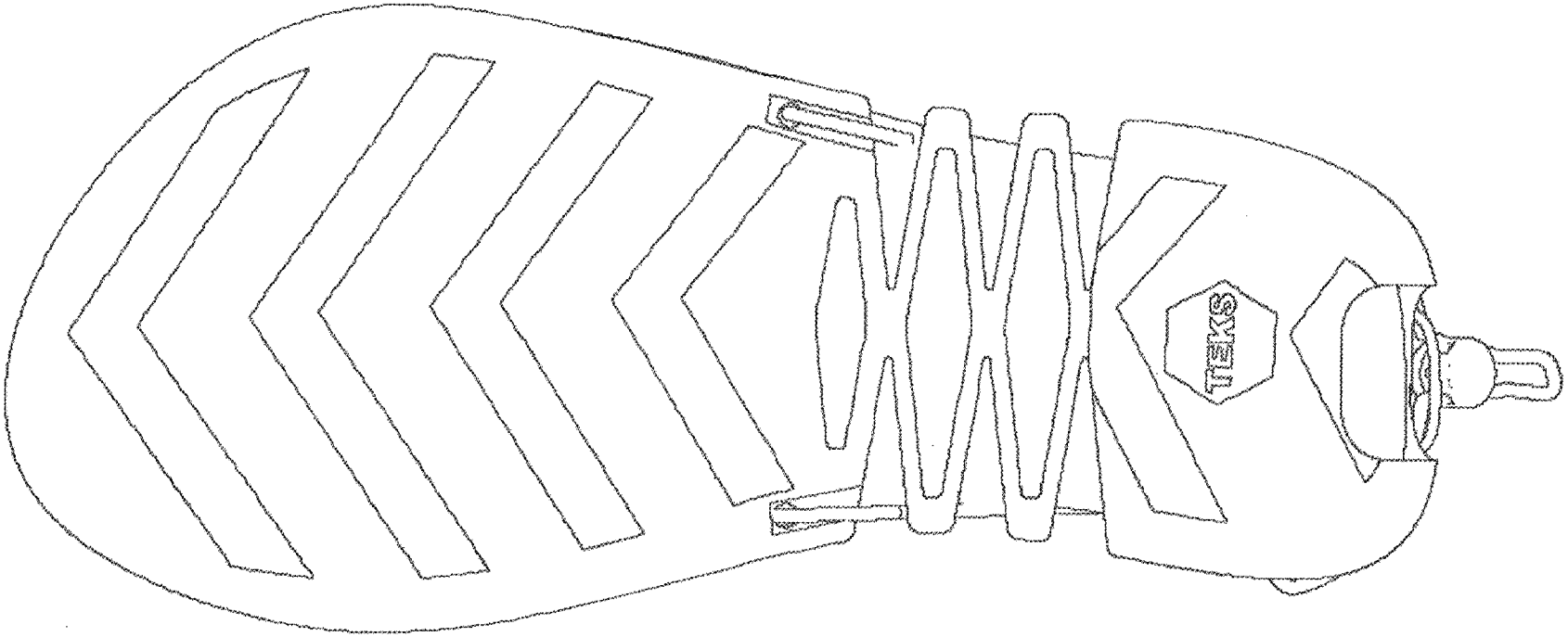
FIG. 4 is a bottom view of the wearable shoe cover of FIG. 1.
Figure 5:
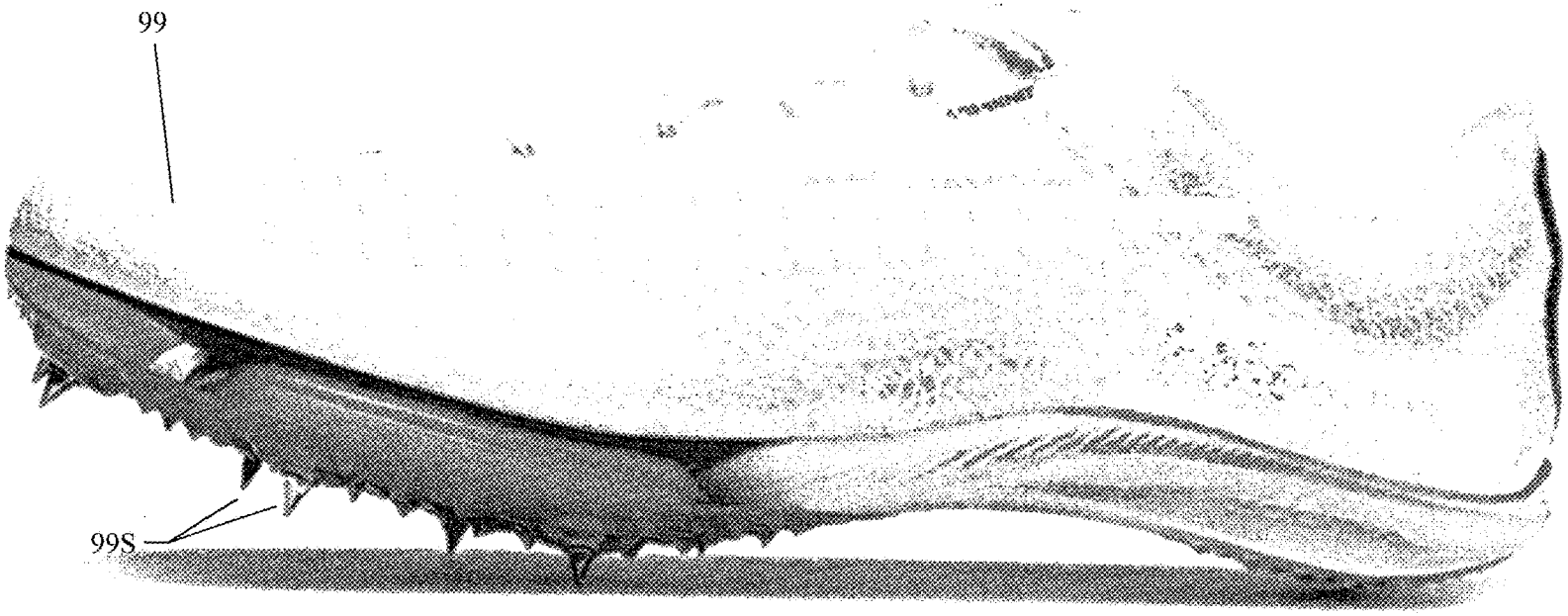
FIG. 5 is a side view of a spiked athletic shoe that may receive the cover of FIG. 1.
Figure 6:
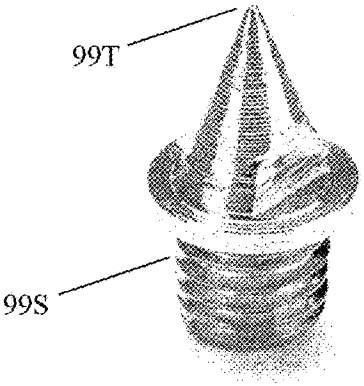
FIG. 6 is a perspective view of a replaceable metal spike that is usable in the spiked athletic shoe of FIG. 5.
Figure 11B:
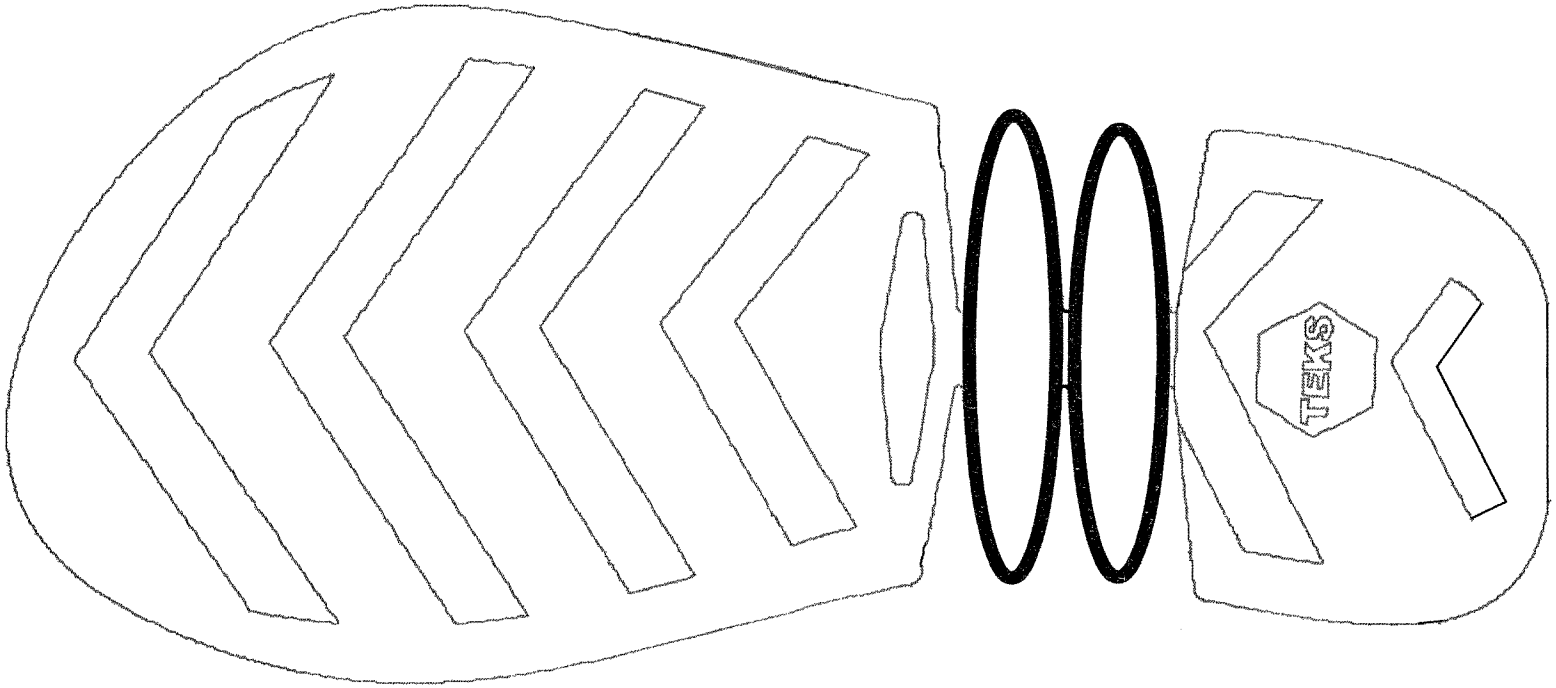
FIG. 11B is the shoe cover as seen in the bottom view of FIG. 4, but is shown with yet a different structural arrangement for the accordion-like structure at the mid-section of the cover.
Figure 11C:
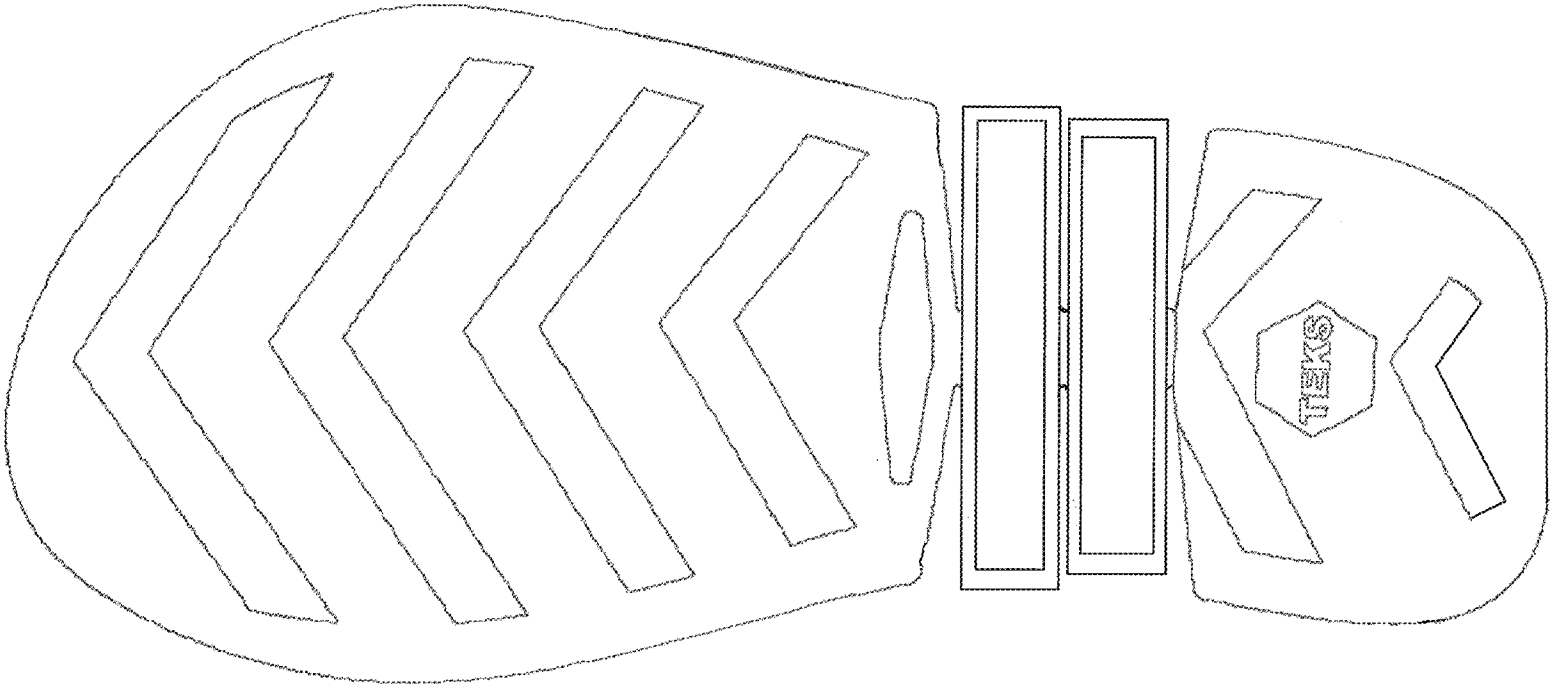
FIG. 11C is the shoe cover as seen in the bottom view of FIG. 4, but is shown with yet another different structural arrangement for the accordion-like structure at the mid-section of the cover.
Figure 11D:
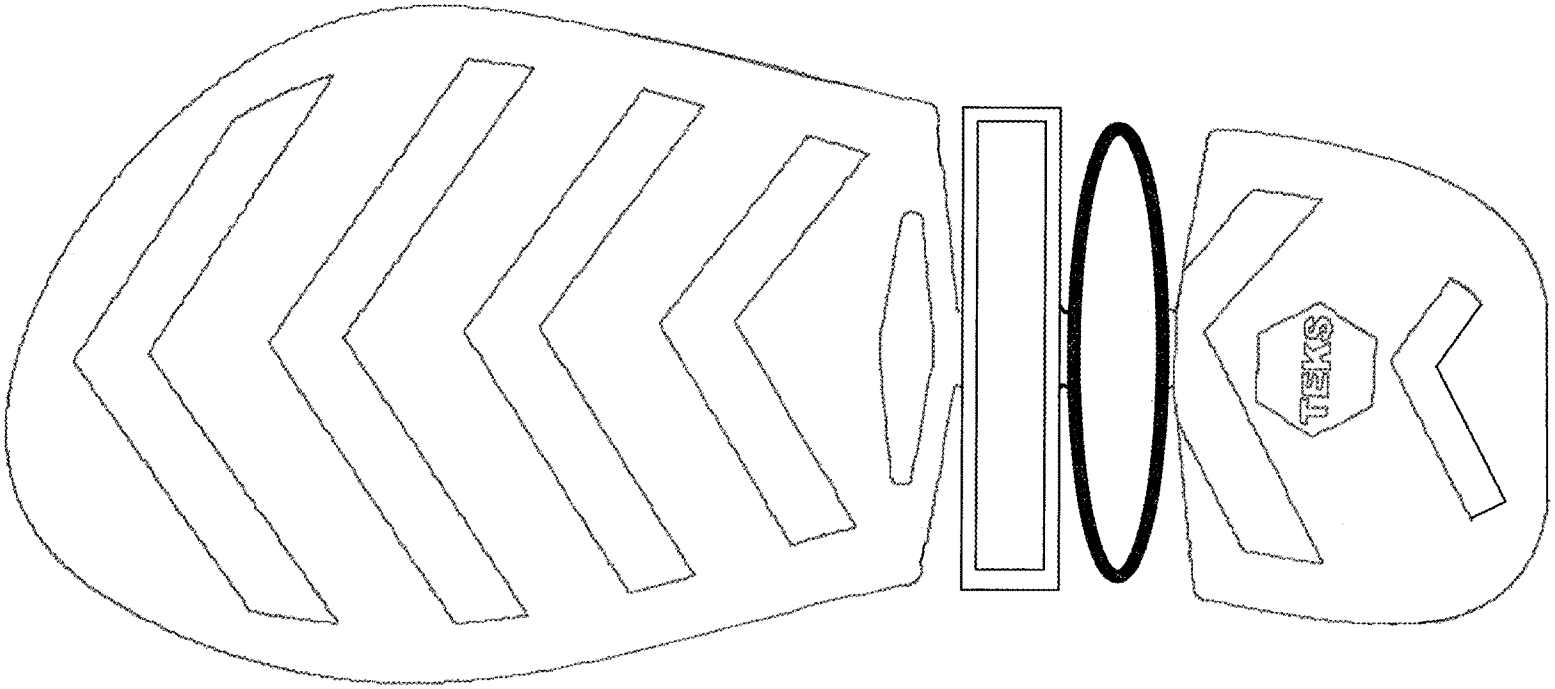
FIG. 11D is the shoe cover as seen in the bottom view of FIG. 4, but is shown with yet another structural arrangement for the accordion-like structure at the mid-section of the cover, which include a plurality of different geometric shapes being used for the accordion-like structure.
Figure 11E:
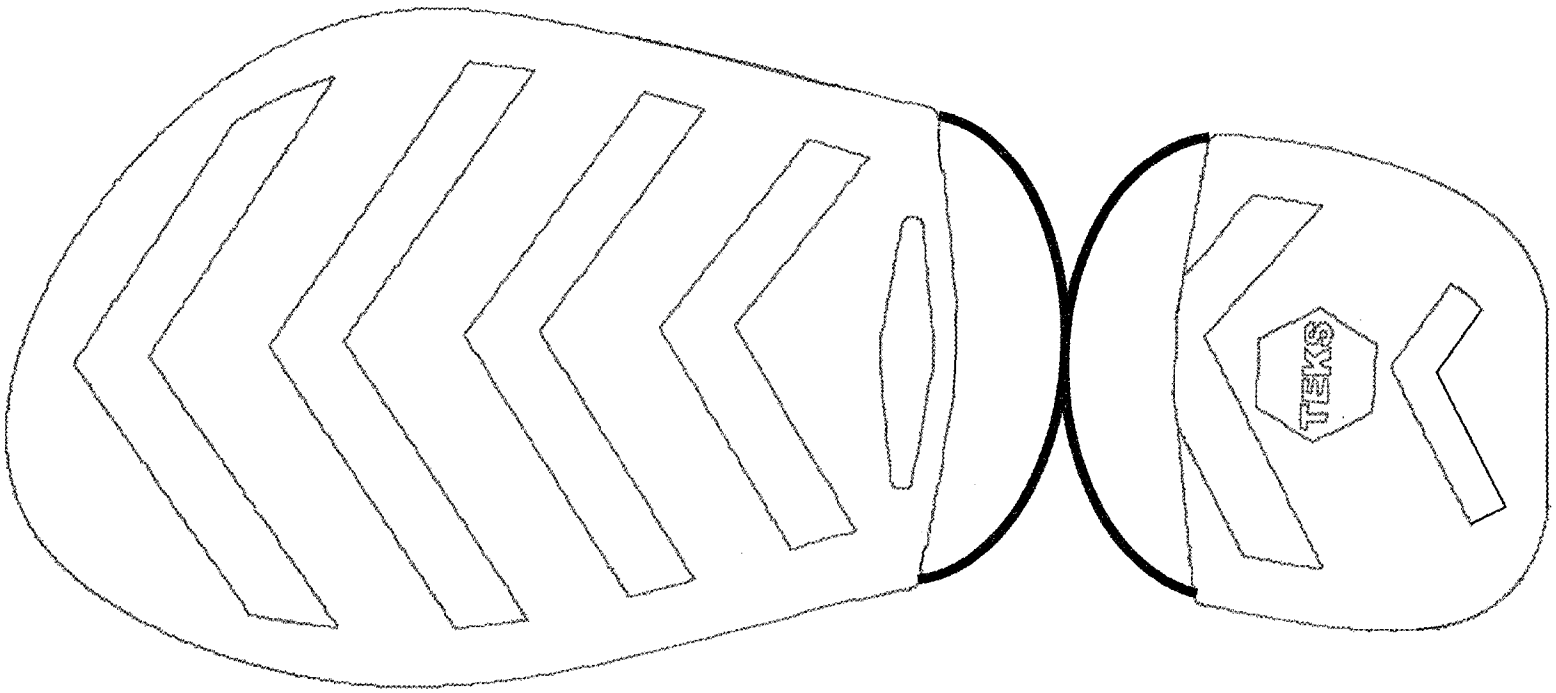
FIG. 11E is the shoe cover as seen in the bottom view of FIG. 4, but is shown with yet a different structural arrangement for the accordion-like structure at the mid-section of the cover (e.g., an "X" shape).

The accordion-like structure may be formed of an enclosed shape. The accordion-like structure may be formed of one or more elongated hexagon shapes that are connected together, as seen in FIG. 3, and which may behave like a spring while nonetheless still providing the needed vertical support. A standard hexagon is a six-sided polygonal shape where all the sides are equal in length. However, as utilized herein, each elongated hexagonal shape may be formed to have a first long side 111 and a second long side 112 that are connected by a short side 115, and which first and second long sides respectively transition into a third long side 113 and a fourth long side 114, which third and fourth long sides are similarly connected by a short side 116 of the elongated hexagonal shape. It is also contemplated that other shapes other than the elongated hexagonal shape may alternatively be used for the accordion-like structure, including, but not limited to, the diamond shape seen in FIG. 11A, the elliptical shapes of FIG. 11B, the rectangular shapes of FIG. 11C, etc. It is furthermore contemplated that a combination (i.e., a plurality) of different such shapes could be used to create the accordion-like structure, as may be seen, for example, in FIG. 11D. Also, any one of these particular shapes (or other shapes, e.g., an "X" shape) may be used, as shown for example in FIG. 11E. To provide for an additional mount of flexible expansibility, the front portion 100A may be formed to include a through-opening 105 that may have a peripheral shape that may be similar to, or the same as, the shape used for the accordion-like structure.

Being so constructed, in one embodiment, the front portion 100A, the mid-portion 100B, and the rear portion 100C of the wearable shoe cover 100, while being worn on the spiked athletic shoe 99, may each provide vertical rigidity to react ground impact loading including when the athlete may be accelerating. See e.g., "Effect of Acceleration on Optimization of Adidas Bounce Shoes," Mathew James Dickson and Franz Konstantin Fuss, *Procedia Engineering* 13, 107-112 (201).

Structural support at the mid-section of the prior art shoe covers for a spiked athletic shoe 99 is typically inadequate, and is even non-existent where expansibility has been considered—see e.g., U.S. Pat. No. 4,872,273 to Smeed for a "Spike Shoe Slip." This mid-section support is a critical aspect of the design and functionality of such a shoe cover. See e.g., "Towards a Footwear Design Tool: Influence of Shoe Midsole Properties and Ground Stiffness on the Impact Force During Running," Ly, Quoc Hung, et al., *Journal of biomechanics* 43.2 (2010): 310-317.

The accordion-like structure of the mid-portion 100B of the herein disclosed wearable shoe cover 100 addresses this aspect of supporting the foot of the athlete wearing a spiked athletic shoe 99 onto which the cover is applied.

It is contemplated that the entirety of the wearable shoe cover 100 may be made of a thermoplastic polyurethane (TPU) material, a polyvinyl chloride (PVC), natural rubber, silicone rubber, blown rubber, an outsole-grade Ethylene-Vinyl Acetate (EVA), a composite material, etc.

It is also contemplated that each of the different portions of the wearable shoe cover 100—e.g., the front portion 100A, the mid-portion 100B, and the rear portion 100C—may be made of a different material that may be particularly selected for its position in the shoe cover and the corresponding portion of the spiked athletic shoe 99 to be protected, because of the various different impact loads and the type of contact that may be experienced at each of those locations.

Figure 10:
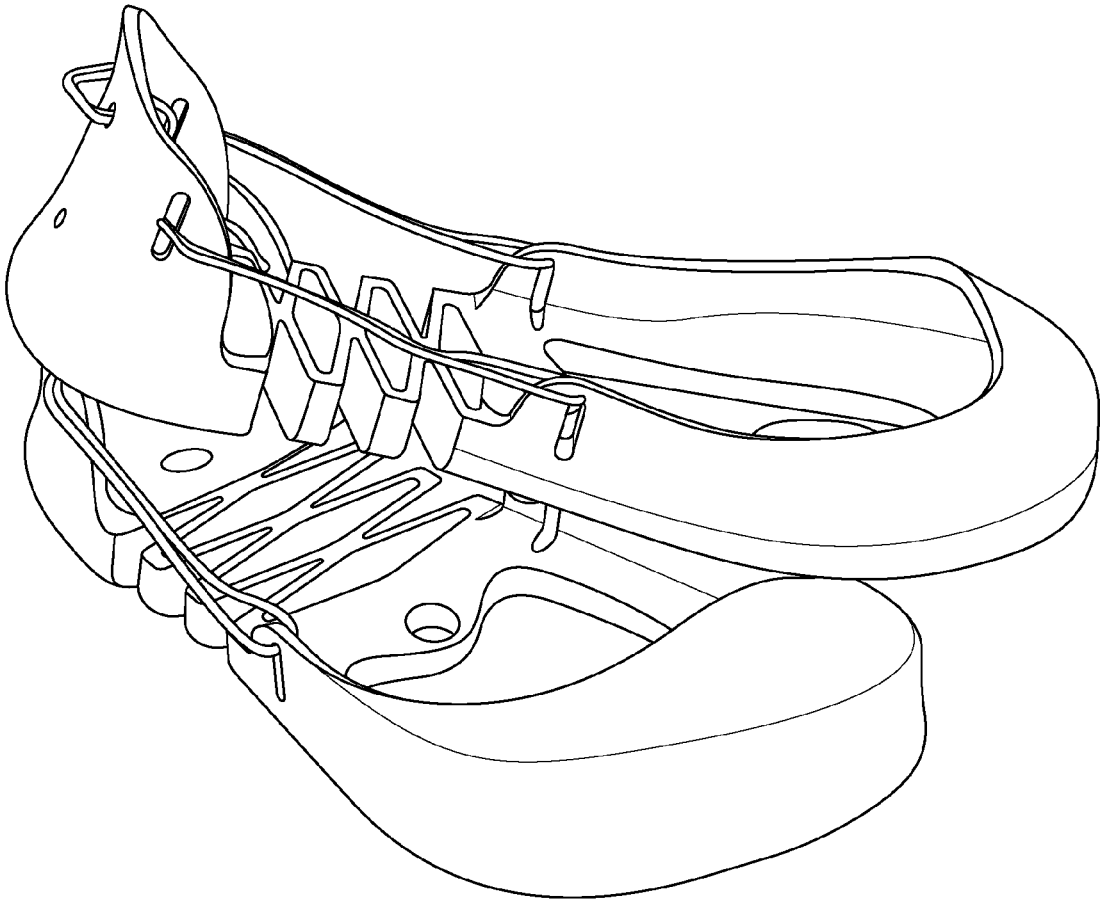
FIG. 10 is a perspective view of an alternate embodiment of the shoe cover of FIG. 1.

In one embodiment, the wearable shoe cover 100 may be utilized as described herein above, with the accordion-like structure providing a sufficient (elastic) retaining force for the cover to remain secured to the spiked athletic shoe 99 during use. In another embodiment, the wearable shoe cover 100 may also include one or more cords 118 that may be used to create a force couple and a resulting moment between the rear portion 100C and the front portion 100A and/or the mid-portion 100B, which may provide an even greater retaining force for securing of the cover to the spiked athletic shoe 99. In one embodiment, as seen in FIGS. 1-9, the ends of the cord 118 may pass through openings (hole or slits) in the rear portion 100C and be secured to the front portion 100A and/or the mid-portion 100B, and may thereafter be tensioned by the wearer, and may be secured as tensioned using a cord lock 119, which may be a spring-biased cord lock. The cord 118 may be substantially inelastic, or may be slightly elastic. In another embodiment, as seen in FIG. 10, a cord may be used that may be generally elastic, and may be used with a fixed cord length (and no cord lock) such that the cord applies a load when the wearable shoe cover 100 is placed upon the spiked athletic shoe 99.

Various different embodiments are contemplated, as described hereinafter, with respect to the length of the accordion-like structure and the expansibility thereby provided. It is contemplated that in one embodiment the distance between the toe wall 104 and Achillies-tendon-adjacent wall 107 may be greater than the length of a size 13 spiked athletic shoe 99, and that the cord 118 and cord lock 119 may be used to compress the accordion-like structure for that cover embodiment to suitably be secured upon any sized spiked athletic shoe 99, even down to a size 6½. It is further contemplated that in another embodiment, the distance between the toe wall 104 and Achillies-tendon-adjacent wall 107 may be just smaller than the length of a size 6½ spiked athletic shoe 99, and that expansion of the accordion-like structure for that cover embodiment may permit it to be independently secured upon any sized spiked athletic shoe 99, even up to a size 13, and that the use of the cord 118 and cord lock 119 may be eliminated or may be optional, being used merely to provide a redundant tensioning force to supplement such securement by the accordion-like structure. It is further contemplated that in yet another embodiment, the distance between the toe wall 104 and Achillies-tendon-adjacent wall 107 may be right in-between (e.g., the average of) the different lengths of a size 6½ and a size 13 spiked athletic shoe 99 (e.g., about a size 9½), and that expansion of the accordion-like structure for that cover embodiment may permit it to be independently secured upon a larger sized spiked athletic shoe 99 (i.e., being larger than a size 9½ up to a size 13), and that the cord 118 and cord lock 119 would be needed to compress the accordion-like structure for that cover embodiment to suitably be secured upon a smaller sized spiked athletic shoe 99 (i.e., being smaller than a size 9½ down to a size 6½).

As noted above, and as may be understood from FIG. 7, the wearable shoe cover 100 may be placed upon the spiked athletic shoe 99 by initially placing the top of the front end of the spiked athletic shoe 99 underneath the crown portion 104CR of the toe wall 104 such that it may be deformed upwardly, and by next rotating the shoe cover onto the rest of the spiked athletic shoe 99, so that the spikes 99S do not gouge into the pad 103P, when the pad may be utilized in the shoe cover 100.

The wearable shoe cover 100 may also include a pad 128 that may be releasably or fixedly secured to the inward-facing side of the wall 107 of the cover, using any suitable attachment scheme, including, but not limited to, any one or more of: the cord(s) 118 (as may best be seen in FIG. 1), mechanical fasteners (e.g., rivets), adhesive, a piece of hook type material secured to the pad and a piece of the corresponding loop type material secured to the wall 107, which hook and loop materials are descriptive names for such materials that are sold under the trademark VELCRO®. The pad 128 may provide an additional retention force for securing the cover to the spiked athletic shoe 99 to redundantly serve in preventing the shoe heel from slipping out of the cover. The pad 128 may provide an additional friction force between the wall 107 of the cover and the rear wall of the heel portion of the spiked athletic shoe 99, and/or may serve to physically block/impede movement of the rear-most portion of the bottom of the spiked athletic shoe (i.e., the heel), with respect to the cover, a portion of which may extend beneath the pad. The pad 128 may be formed of any suitable material(s) and may also have a coating formed thereon that may serve to increase static/dynamic friction with respect to the spiked athletic shoe 99.

Additional features of the wearable shoe cover 100 may include: one or more openings 125 to receive a magnet; and a heel opening 126 to permit some part of the heel of the spiked shoe 99 to protrude therefrom to relieve tension.

Figure 20:
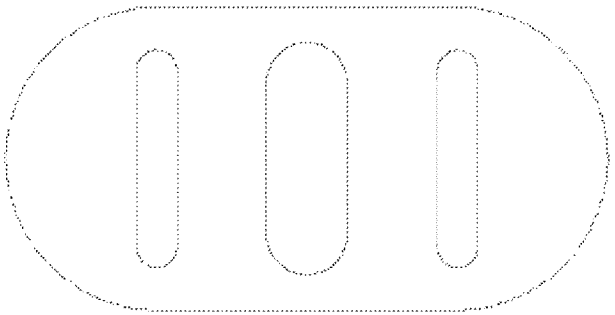
FIG. 20 is a front view of the clip of FIG. 19.

FIGS. 12-18 show a wearable shoe cover 200 that may be formed similar to the wearable shoe cover 100 of FIGS. 1-4, but with some slight differences. For example, the wearable shoe cover 200 may use a band 218 that may have a generally rectangular cross-sectional shape, and which band may also completely circumscribe the periphery of the cover (see FIG. 12 and FIG. 13), having first and second ends 218*a* and 218*b* that may be secured using a clip 219 (see FIG. 12 and FIGS. 19-20). The band may feed through openings, as with openings in the toe wall 204 (e.g., opening 204*i*) of the front portion 200A, and/or through loops, such as loop 200AL, whereby the band may be sandwiched between two thicknesses of the cover material (e.g., between the front portion 203 of the sole and the loop 200Al), and may be engaged therebetween in a friction fit.

Figure 18:
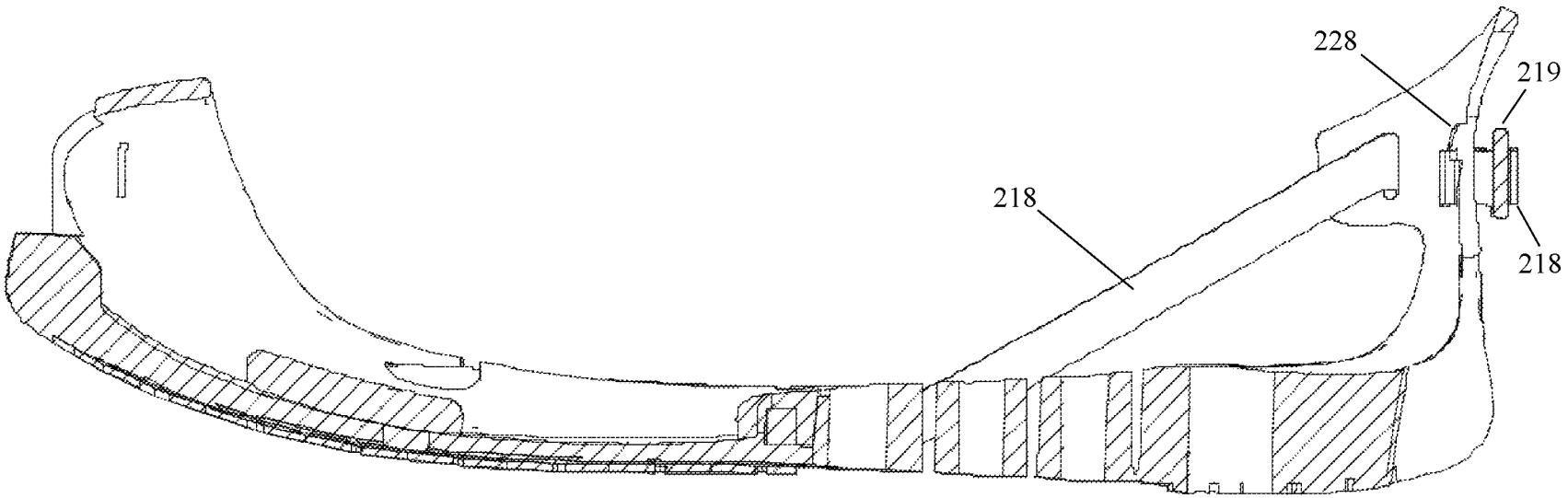
FIG. 18 is a cross-sectional view through the shoe cover of FIG. 12.
Figure 19:
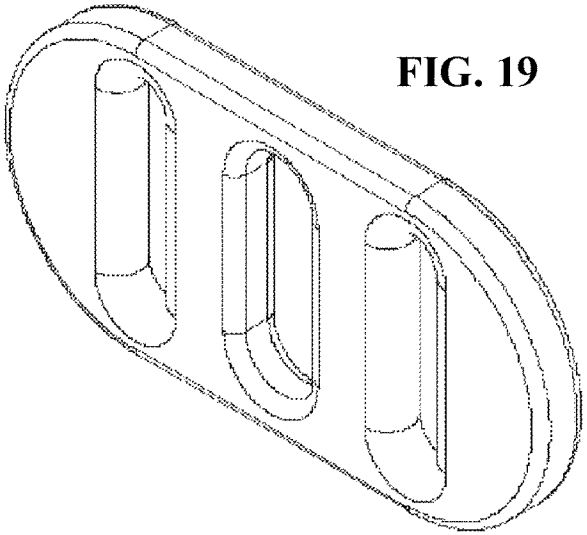
FIG. 19 is a perspective view of the clip used for the shoe cover of FIG. 12.
Figure 21:
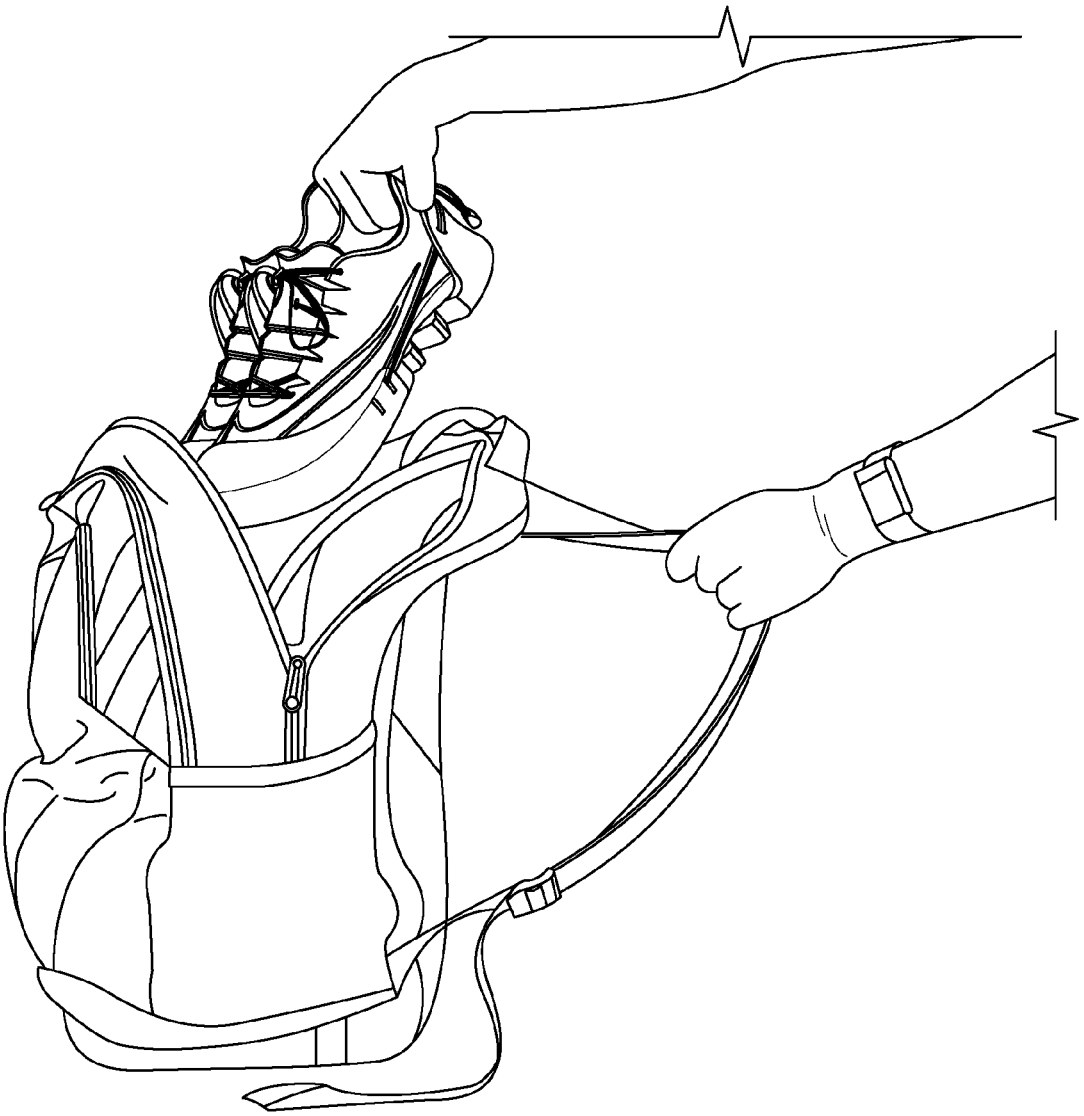
FIG. 21 illustrates a pair of track and field spikes to which have been applied the shoe cover of FIG. 12, prior to being placed in a backpack or gym bag possibly along with a laptop computer, so that the spikes cannot scrap against and scratch/gouge or otherwise damage the surface of the computing device or clothing that may also be contained therein.

The wearable shoe cover 200 may also replace the pad 128 of the shoe cover 100 with a slide member 228, which may be an angled (or outwardly curved) protrusion, beneath which may pass the band 218 (see FIG. 13), where the slide angles outwardly from the upper portion to its bottom portion, so as to overhang outwardly beyond the band 218 (note that, merely to be illustrative, in FIG. 18 the band is shown in a loosened state such that the slide is not seen therein as overhanging the band). The bottom of the slide member 228 (or the band 218) may be used to positively retain the heel of the spiked shoe 99 with respect to the cover (i.e., the heel of the spiked shoe may be trapped between the bottom of the slide member 228 and the top of the sole 206 of the rear portion 100C). The slide member 228 may also prevent the heel from catching on the band 218 at the Achillies-tendon-adjacent wall 207.

Figure 14:
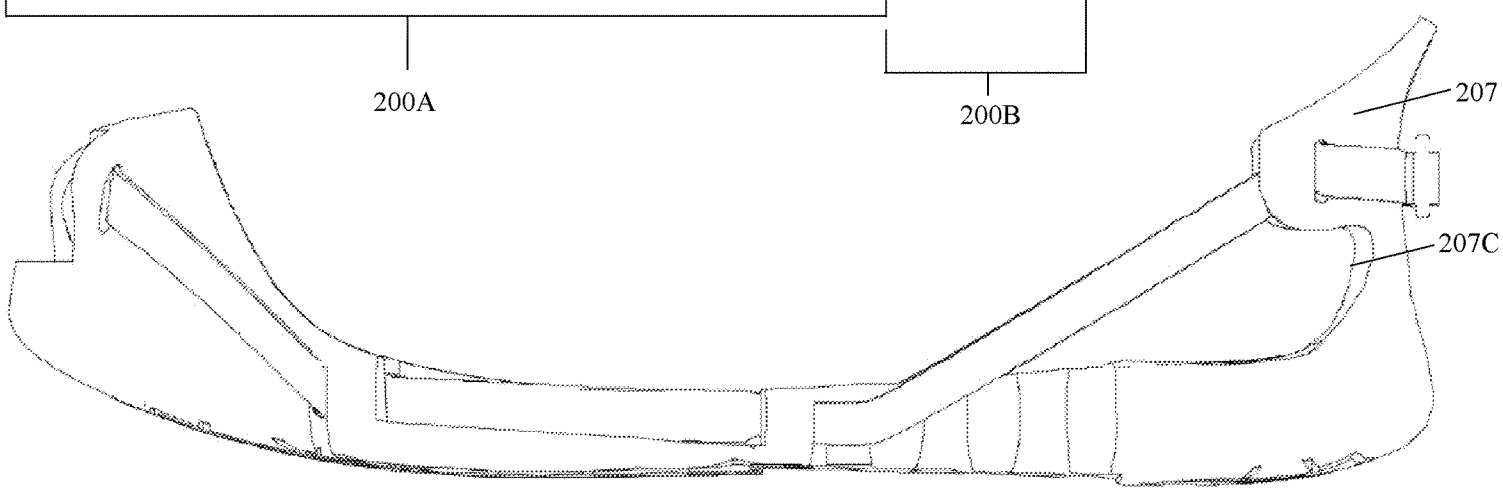
FIG. 14 is a first side view of the shoe cover of FIG. 12.
Figure 15A:
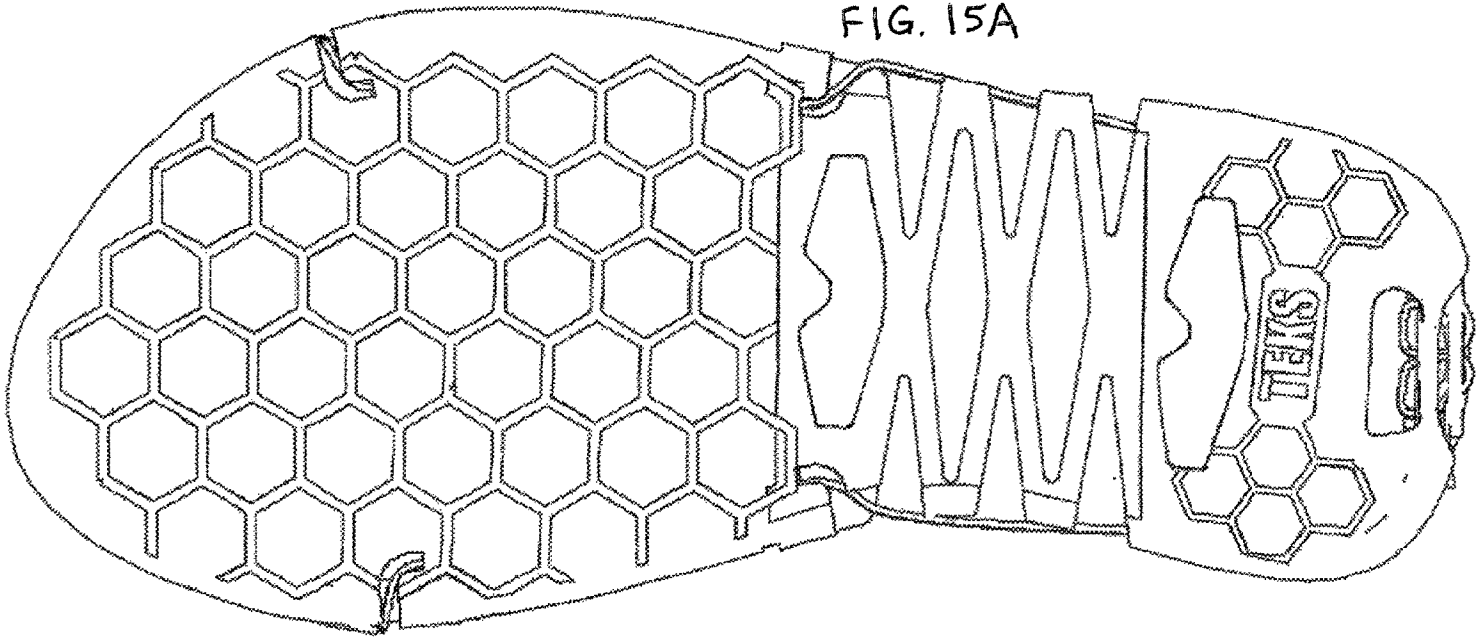
FIG. 15A is a bottom view of the shoe cover of FIG. 12.
Figure 14A:
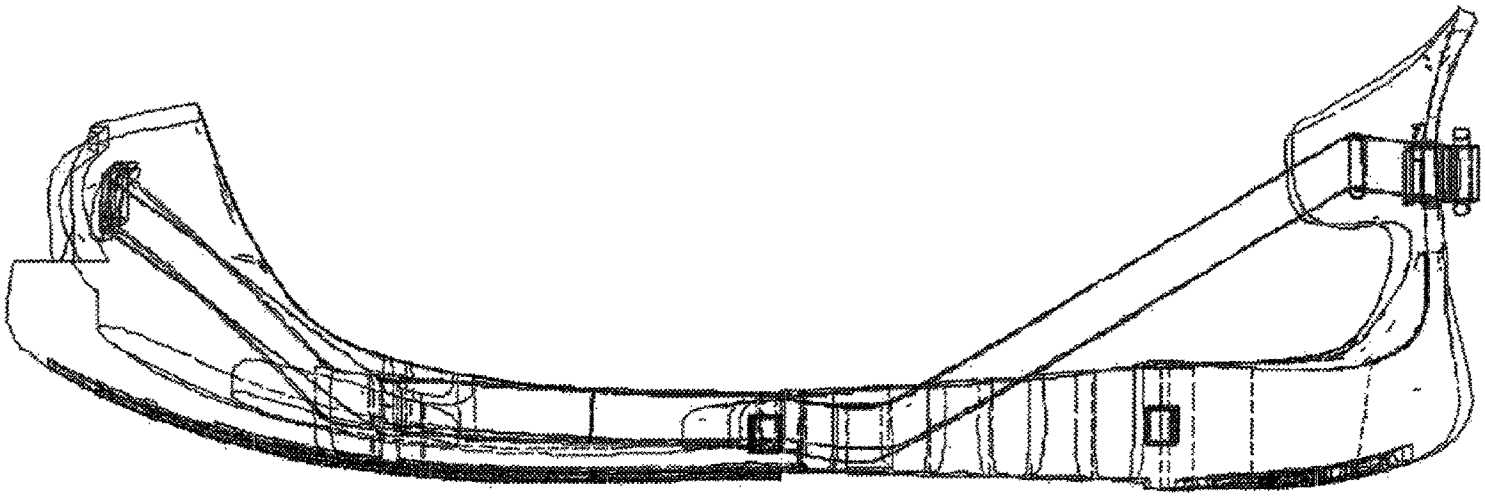
FIG. 14A is a second side view of the shoe cover of FIG. 12.
Figure 17:
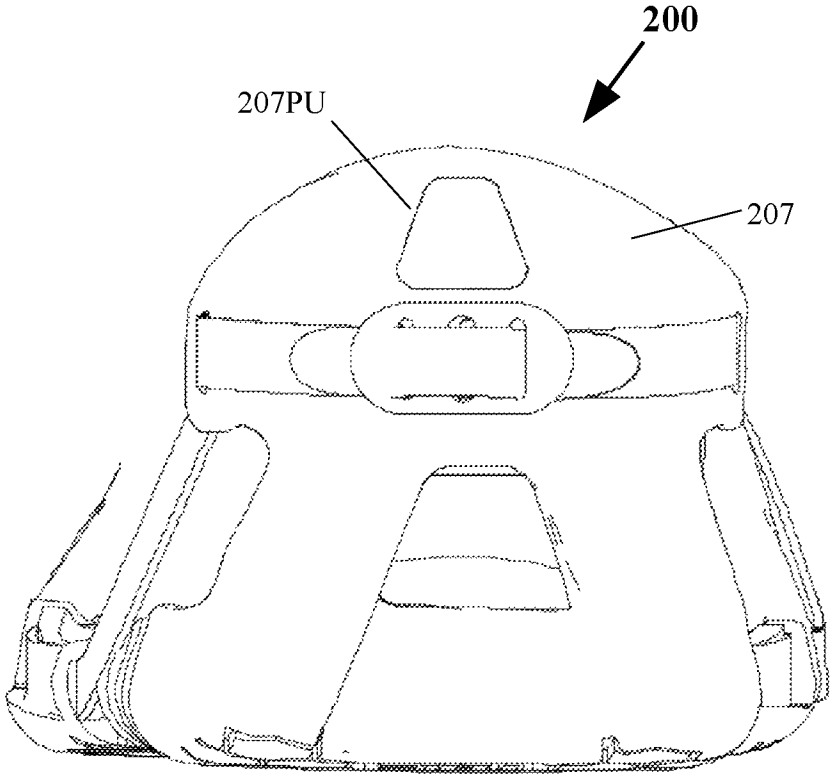
FIG. 17 is a rear view of the shoe cover of FIG. 12.
Figure 16:
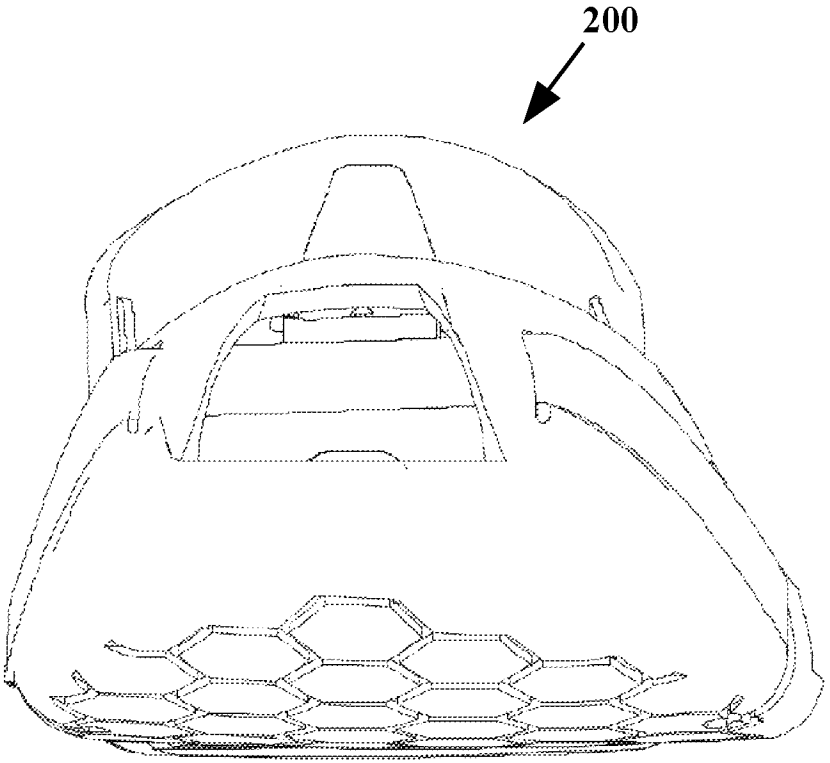
FIG. 16 is a front view of the shoe cover of FIG. 12.

The Achillies-tendon-adjacent wall 207 of the rear portion 200C of the wearable shoe cover 200 may also be cut away at 207C, as seen in FIG. 14, to better accommodate different heel sizes (e.g., larger/wider heels) of the various different styles/brands of spike shoes 99.

The wearable shoe cover 200 may also include an upper opening 207PU in the top portion of the Achillies-tendon-adjacent wall 207, to permit the user to insert a finger therethrough, to assist in pulling the cover onto the spiked shoe 99.

Figure 13:
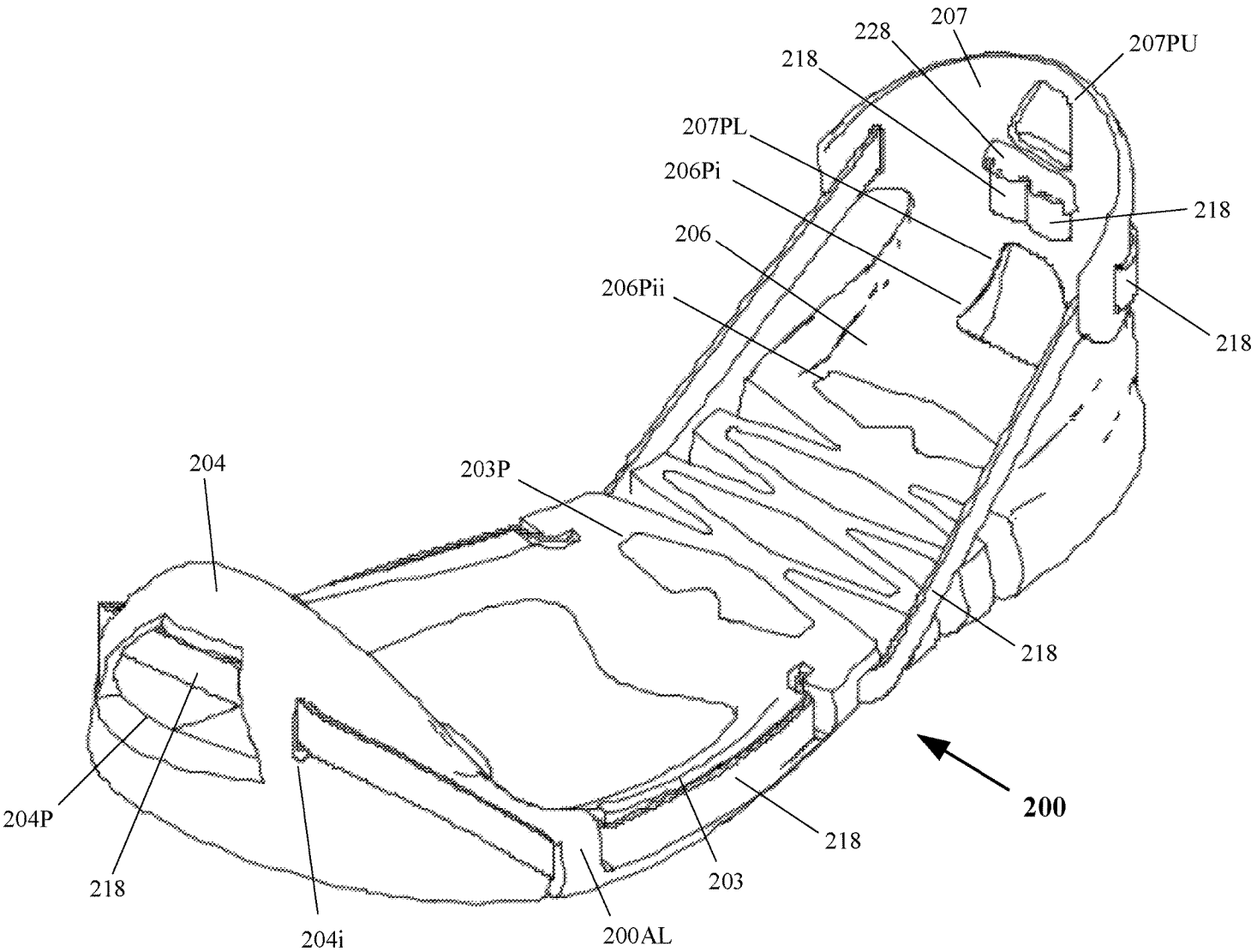
FIG. 13 is a second perspective view of the shoe cover of FIG. 12.
Figure 15:
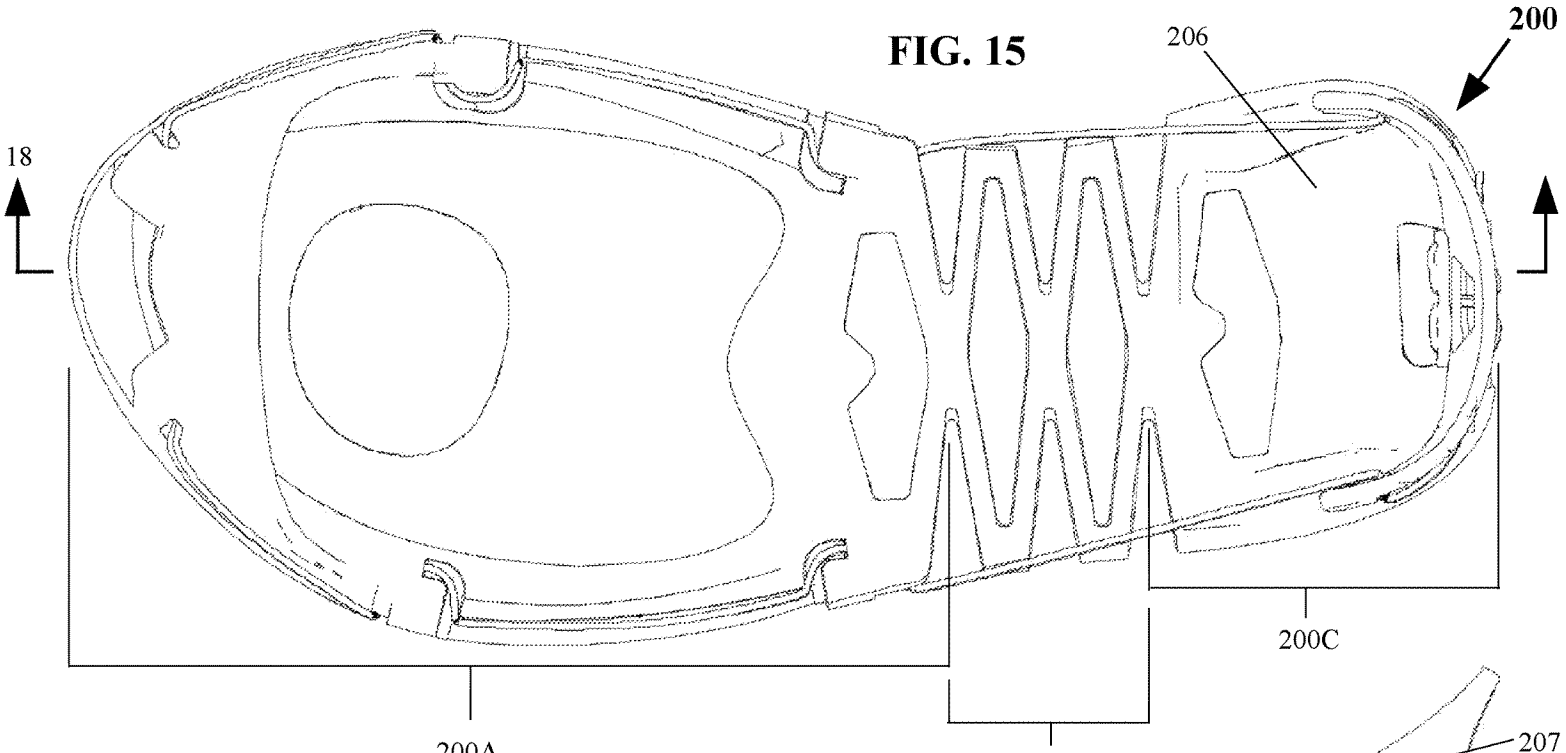
FIG. 15 is a top view of the shoe cover of FIG. 12.

As seen in FIG. 13, the wearable shoe cover 200 may also include a lower opening 207PL in the bottom portion of the Achillies-tendon-adjacent wall 207, to provide for relief if the spike shoe being received into the cover has a rear protrusion, as is the case with, for example, the Nike® running spike known as the MAXFLY 2®. The lower opening 207PL in the bottom portion of the Achillies-tendon-adjacent wall 207 may transition into an opening 206Pi in the sole 206 of the rear portion 100C, to provide a more aesthetically pleasing shape for that combined opening.

The wearable shoe cover 200 may also include an opening 204P in the toe wall 204, to enable frictional contact directly between the tensioned band 218 and the upper front portion of the running spike 99, when installed properly in the cover, which may serve to more securely retain the cover on the spiked shoe 99. The inner periphery of the opening 204P may be contoured and shaped so the front of the toe portion of the spiked shoe 99 is nested therein. The outwardly facing side of the opening 204P may also be shaped and sized to provide a more aesthetic appearance for the front of the wearable shoe cover 200.

The wearable shoe cover 200 may utilize any one or more of the different construction options/shapes described herein for the expandable center section 200B. In addition, the expandable center section 200B may more simply be an elastic member (e.g., an elongated elastic box-like shape-see FIG. 11F), and does not include any of the preferred open shaped features illustrated in FIGS. 11A-11E.

Also, as shown in FIG. 13, to add additional flexibility (i.e., additional expansible capability), the front portion 203 of the sole may have an elongated opening 203P that may have a periphery that may be shaped similar to the enclosed shape(s) of the mid-section 200B, and the sole 206 of the rear portion 100C may also have a similarly shaped opening 206Pii.

Figure 11F:
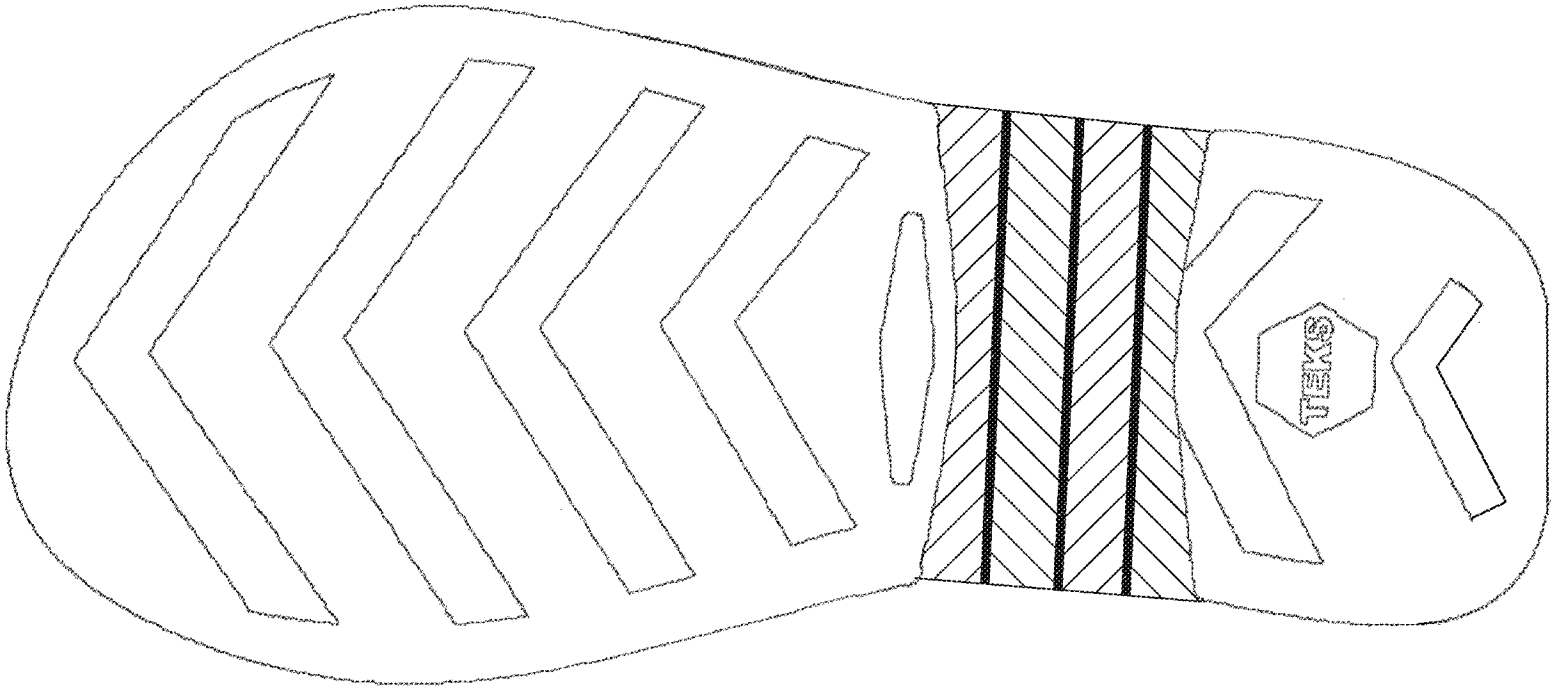
FIG. 11F is the shoe cover as seen in the bottom view of FIG. 4, but is shown with yet a different structural arrangement for the accordion-like structure at the mid-section of the cover, which is not be an enclosed geometric shape, and instead is an elongated box-like shape formed of both a highly elastic material that connects the front toe portion to the rear heel portion, and which is interrupted by a stiffer material that may provide vertical support at the midsection.
Figure 12:
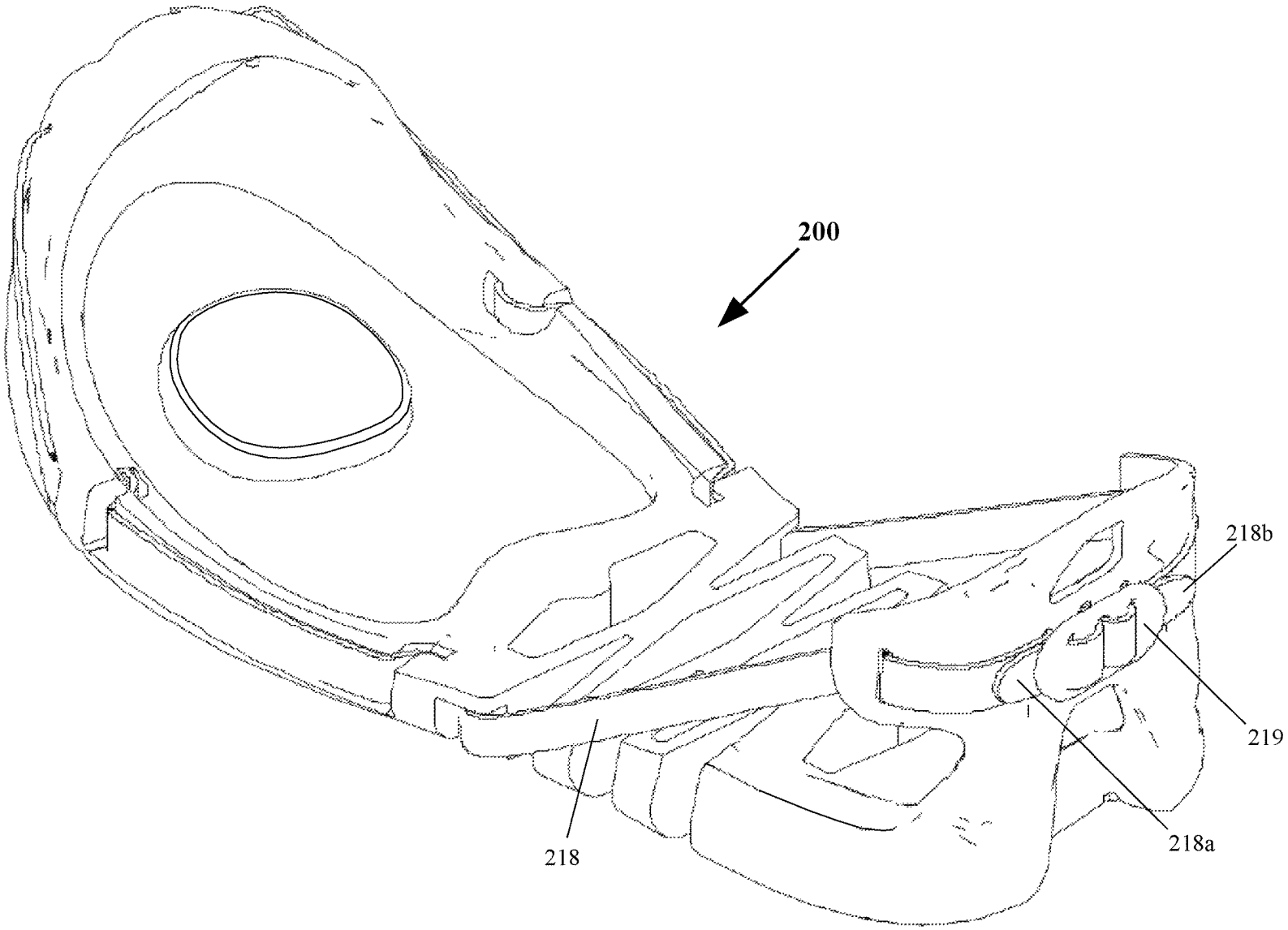
FIG. 12 is a first perspective view of another alternate embodiment of the shoe cover of FIG. 1.

FIG. 11F shows an accordion-like structure at the mid-section of the cover, which is an elongated box-like shape formed of a highly elastic material (e.g., rubber, shown in FIG. 11F with cross-hatching) that connects the front toe portion to the rear heel portion, and which is interrupted by a stiffer material (e.g., a rubber with a much higher modulus of elasticity or even a plastic, including, but not limited to, ABS plastic, shown by the dark, transversely oriented lines in FIG. 11F), which may provide vertical support at the midsection.

While illustrative implementations of one or more embodiments of the disclosed system are provided hereinabove, those skilled in the art and having the benefit of the present disclosure will appreciate that further embodiments may be implemented with various changes within the scope of the disclosed system. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

The invention claimed is:

1. A shoe cover, for use with an athletic shoe having anti-skid protrusions on one or more portions of a bottom surface of a sole of the athletic shoe, said shoe cover comprising:

a toe and ball portion, said toe and ball portion comprising: a sole portion configured to provide support to a bottom of a toe region and a ball region of the athletic shoe; and a toe wall configured to extend away from said sole portion being configured, in combination with said sole portion, to form a toe box that extends around at least a front, a top, and a bottom of the toe region of the athletic shoe when said shoe cover is secured thereto, said toe box thereby configured to receive and have nested therein each of the front, the top, and the bottom of the toe region of the athletic shoe;

a heel portion, said heel portion comprising: a sole portion and an Achillies-tendon-adjacent wall;

a mid-section;

wherein said midsection is joined to each of said toe and ball portion and to said heel portion;

wherein said mid-section comprises: a selective shape formed as an accordion-like structure being configured to provide adjustability with respect to a distance between said toe and ball portion and said heel portion; and wherein said accordion-like structure is oriented and configured to provide substantially rigid vertical support to a mid-portion of the athletic shoe and expansibility in an axial direction and a lateral direction.

2. The shoe cover according to claim 1, wherein said accordion-like structure of said mid-section is configured to provide said substantially rigid vertical support being substantially the same as a level of support provided by one or more of said toe portion and said heel portion.

3. The shoe cover according to claim 2, further comprising:

a first band portion, and a second band portion; and wherein each of said first band portion and said second band portion are configured to extend between respective regions of said heel portion and respective regions of said sole portion of said toe portion, to create a force couple and moment between said heel portion and said toe portion, to provide an additional retaining force to secure said shoe cover to the athletic shoe.

4. The shoe cover according to claim 3, further comprising: a recess in said toe and ball portion, said recess configured to receive the anti-skid protrusions of the athletic shoe therein without contact between a tip of the anti-skid protrusions and an adjacent region of said sole portion of said toe and ball portion.

5. The shoe cover according to claim 4, further comprising:

a pad, said pad configured to be received within said recess.

6. The shoe cover according to claim 5, wherein said pad is formed of an elastomeric material and is thereby configured to elastically deform as a result of contact with the anti-skid protrusions of the athletic shoe, when said shoe cover is secured to the athletic shoe.

7. The shoe cover according to claim 6, further comprising:

a slide member, said slide member configured to extend away from a central region of said Achillies-tendon-adjacent wall, and to angle outwardly; and wherein said slide member is configured to secure a heel of the athletic shoe with respect to said shoe cover, with the heel being trapped between a bottom surface of said slide member and a top surface of said sole portion of said heel portion.

8. The shoe cover according to claim 1, wherein said accordion-like structure comprises: a plurality of enclosed shapes, each arranged linearly, and each being connected to an adjacent said enclosed shape only at a medial location.

* * * * *